US006543892B2

(12) United States Patent
Kubota et al.

(10) Patent No.: US 6,543,892 B2
(45) Date of Patent: Apr. 8, 2003

(54) PRINTING APPARATUS

(75) Inventors: Masahiko Kubota, Tokyo (JP); Hideo Saikawa, Tokyo (JP); Tsutomu Shimada, Tokyo (JP); Tsuyoshi Santo, Kanagawa (JP); Kenji Maeda, Kanagawa (JP); Yoshifumi Fujita, Kanagawa (JP); Shinjiro Hori, Kanagawa (JP); Takeshi Yazawa, Kanagawa (JP); Yoichi Takada, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 27 days.

(21) Appl. No.: 09/814,985

(22) Filed: Mar. 23, 2001

(65) Prior Publication Data

US 2001/0038410 A1 Nov. 8, 2001

(30) Foreign Application Priority Data

Mar. 27, 2000 (JP) ..... 2000-087261

(51) Int. Cl.[7] ..... B41J 3/36
(52) U.S. Cl. ..... 347/109
(58) Field of Search ..... 347/108, 109, 347/14; 400/88

(56) References Cited

U.S. PATENT DOCUMENTS

| | | | | |
|---|---|---|---|---|
| 4,313,124 A | | 1/1982 | Hara | 347/57 |
| 4,345,262 A | | 8/1982 | Shirato et al. | 347/10 |
| 4,459,600 A | | 7/1984 | Sato et al. | 347/47 |
| 4,463,359 A | | 7/1984 | Ayata et al. | 347/56 |
| 4,558,333 A | | 12/1985 | Sugitani et al. | 347/65 |
| 4,608,577 A | | 8/1986 | Hori | 347/66 |
| 4,723,129 A | * | 2/1988 | Endo et al. | 347/45 |
| 4,740,796 A | | 4/1988 | Endo et al. | 347/56 |
| 4,860,034 A | * | 8/1989 | Watanabe et al. | 347/14 |
| 4,915,027 A | * | 4/1990 | Ishibashi et al. | 400/88 |
| 5,842,793 A | * | 12/1998 | Katayama et al. | 400/88 |

FOREIGN PATENT DOCUMENTS

| | | |
|---|---|---|
| JP | 54-56847 | 5/1979 |
| JP | 59-123670 | 7/1984 |
| JP | 59-138461 | 8/1984 |
| JP | 60-71260 | 4/1985 |
| JP | 9-248939 | 9/1997 |

* cited by examiner

*Primary Examiner*—John Barlow
*Assistant Examiner*—Julian D. Huffman
(74) *Attorney, Agent, or Firm*—Fitzpatrick, Cella, Harper & Scinto

(57) ABSTRACT

Disclosed is a portable, hand-held printing apparatus capable of maintaining high printing quality even when the movement of the apparatus becomes unstable due to looseness or wrinkles of a printing medium or even when the moving velocity of the apparatus changes. When a user moves the housing of this apparatus on a printing medium to print on the printing medium by using a printhead, the apparatus itself detects the moving velocity of the housing. On the basis of this detection result, the apparatus adjusts the supply timing of a driving signal for driving the printhead.

6 Claims, 22 Drawing Sheets

X-X' SECTION

PRINTING APPARATUS

FIELD OF THE INVENTION

The present invention relates to a printing apparatus and, more particularly, to a portable, hand-held type printing apparatus, e.g., a printing apparatus which prints data by using an inkjet printhead.

BACKGROUND OF THE INVENTION

Data to be processed by an information processor such as a personal computer is generally printed as visual information on a printing medium by using a desk-top type printing apparatus which prints the visualized information by moving the printing medium. However, with the recent spread of portable information processors such as laptop personal computers, portable printing apparatuses are highly demanded.

Such portable printing apparatuses are also required to be capable of printing data on a printing medium which is difficult to move.

To meet these demands, Japanese Patent Publication Laid-Open No. 9-248939 disclosed a printing apparatus which is manually moved on a printing medium to print data on it. FIGS. 20 and 21 show the manual printing apparatus disclosed in this Patent Publication. These drawings indicate that a printhead 53 and rollers 52 are arranged on the bottom surface of a pillar housing 51. To use this apparatus, a user holds the apparatus and pushes the rollers 52 against a printing medium 54 such as a copying sheet, thereby rotating these rollers 52 and moving the housing 51 in, e.g., a moving direction A. The apparatus outputs a printing timing signal in accordance with the rotation of the rollers 52 and causes the printhead 53 to print data in synchronism with this printing timing signal.

This manual printing apparatus uses an impact type printhead 53, which prints data in contact with the printing medium 54. To prevent degradation of the printing quality caused by changes in the contact force, the printhead 53 is supported by a spring member, and the contact force between the printhead 53 and the printing medium 54 is made stable by the elastic force of this spring member.

In the above prior art, however, the use of the impact type printhead poses the problems that large noise is generated during printing and printing can be performed only on flat printing media. Hence, the use of an inkjet printhead as a typical non-impact type printhead in place of the impact type printhead is being attempted. This inkjet printhead performs non-contact printing by discharging ink onto a printing medium. Therefore, the inkjet printhead can print data with low noise on printing media made from various materials. In addition, high printing quality can be obtained without stabilizing the contact force between a printhead and a printing medium unlike a case where the conventional impact type printhead is used.

If, however, the printhead of the arrangement shown in FIGS. 20 and 21 is simply replaced by the inkjet printhead, printing still becomes nonuniform due to a variation in the biasing force applied from the rollers 52 to the printing medium 54 when the housing is moved, a variation in the pressure being pushed by each roller 52, and a fluctuation in the moving direction A, which are caused by a shake by the hand or the like. Furthermore, when data is to be printed on a printing medium which easily expands and shrinks, such as a printing sheet placed in high-humidity environment, inferior printing readily occurs due to looseness or wrinkles of the printing medium while printing is executed by moving the housing. This problem is an extremely large burden on users who must move the printing apparatus with stable hands that do not cause the apparatus to vibrate.

The internal construction of the apparatus shown in FIGS. 20 and 21 is as follows. That is, the housing contains a moving amount detecting means which detects the moving amount of the housing by using an encoder which rotates in contact with a printing medium, and a printhead (line head) in which printing elements are arrayed in the form of a line. Since this type of portable apparatus is battery-driven, it is difficult to supply a large amount of power at one time. This makes it infeasible to simultaneously drive all printing elements (heaters) of the line head. Hence, printing is performed by time-division control by dividing the heaters of the line head into blocks. Unfortunately, this method also poses the following problems because the user manually moves the housing.

The housing moving velocity is not constant.

Since the moving velocity is not constant, the printing position shifts by the time-division control. This makes it difficult to print data over a broad region of a printing medium while constant printing quality is held. Accurate printing is sometimes impossible to perform.

Since the moving velocity is not constant, it is difficult to control printing by calculating printing timings.

SUMMARY OF THE INVENTION

Accordingly, it is an object of the present invention to provide a portable, hand-held printing apparatus capable of maintaining high printing quality even when the movement of the apparatus becomes unstable due to looseness or wrinkles of a printing medium or even when the moving velocity of the apparatus changes.

According to the present invention, the foregoing object is attained by providing a printing apparatus for printing on a printing medium by using a printhead while a user moves a housing on the printing medium, comprising: detecting means for detecting the moving velocity of the housing; supply means for supplying a driving signal for driving the printhead; holding means for holding a plurality of velocity thresholds; and adjusting means for comparing a detection result from the detecting means with the plurality of velocity threshold, and adjusting the supply timing of the driving signal on the basis of the comparing result.

It is preferable to further comprise driving means for driving a plurality of printing elements of the printhead by the driving signal, temperature detecting means for detecting the temperature of the printhead, and driving control means for controlling driving by the driving means on the basis of the temperature detected by the temperature detecting means.

In this apparatus, the driving control means preferably controls driving by time-divisionally controlling the plurality of printing elements and/or by adjusting the pulse width of the driving signal.

The apparatus preferably further comprises input means for inputting printing data from an external apparatus, e.g., input means which communicates with the external apparatus by infrared communication to input the printing data.

The apparatus desirably further comprises a roller for assisting movement of the housing.

The printhead is preferably an inkjet printhead which prints by discharging ink. This inkjet printhead preferably comprises an electrothermal transducer for generating thermal energy to be given to ink, in order to discharge the ink by using the thermal energy.

The detecting means preferably detects the moving velocity of the housing in a plurality of stages by using a plurality of velocity thresholds. The adjusting means preferably converts the moving velocity of the housing detected in the plurality of stages by the detecting means, into a control signal for adjusting the supply timing of the driving signal by using a conversion table.

In accordance with the present invention as described above, when a user moves a housing on a printing medium to print data on this printing medium by using a printhead, the moving velocity of the housing is detected. On the basis of the result of comparing the detection result with a plurality of velocity thresholds, the supply timing of a driving signal for driving the printhead is adjusted.

The invention is particularly advantageous since even when the moving velocity of the housing moved by a user changes for some reason, optimum printing corresponding to the change can be performed. Accordingly, high printing quality can be maintained.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings.

Figure 1:
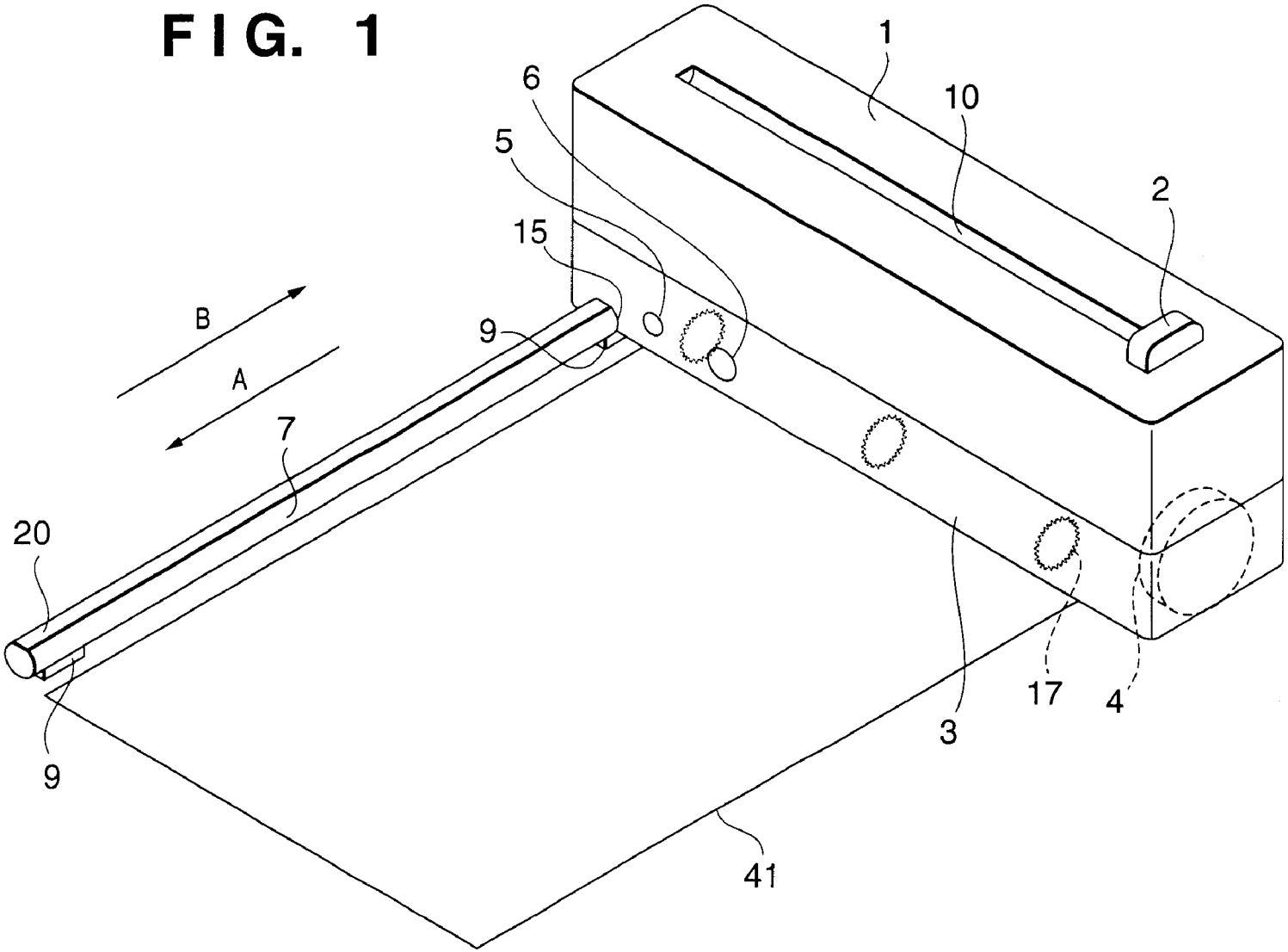
FIG. 1 is a perspective view showing an outline of a portable printing apparatus equipped with an inkjet printhead, as a typical embodiment of the present invention.

FIG. 1 is a perspective view showing an outline of a portable printing apparatus (to be referred to as a printing apparatus hereinafter) equipped with an inkjet printhead, as a typical embodiment of the present invention. FIG. 1 particularly shows the state in which this printing apparatus prints on a printing medium such as a printing sheet 41. The printing apparatus shown in FIG. 1 includes a full-line type inkjet printhead (to be referred to as a printhead hereinafter) having a printing width corresponding to the width of the printing medium.

Referring to FIG. 1, a cap 1 covers the printhead when this printing apparatus is carried (i.e., when no printing is performed), thereby preventing drying of a printhead nozzle portion and adhesion of dust to that portion. A groove 10 is formed in the center in the longitudinal direction of this cap 1, and a lever 2 is provided to be movable along this groove 10. This lever 2 is used to move a wiper used for recovering the printhead. The cap 1 can also be attached to the upper portion of a housing 3 during printing, and thereby serves as a supporting tool when a user scans the housing 3 with his or her hand.

The housing 3 has the printhead for discharging ink and an ink tank for supplying ink to the printhead. The housing 3 also has a PCB (Printer Control Board) for controlling a discharge signal supplied to the printhead and controlling reception and transmission of signals to/from an external apparatus such as a personal computer, and a power supply for supplying electric power to the print head and the PCB. This housing 3 is made of a plastic material such as ABS.

An LED 5 is an indicator for indicating the status of this printing apparatus, and is connected to the PCB (which is used as a wiring board). A switch 6 is also connected to the PCB and functions as input means of the printing apparatus. Although not shown, the housing 3 has an IRDA as an interface for performing signal exchange between this printing apparatus and an external apparatus such as a personal computer by using infrared signals. Furthermore, the housing 3 includes a sensor 40 for sensing the moving amount of the housing 3 by reading a magnetic signal from an encoder 20. The IRDA and the sensor 40 are connected to the PCB.

As shown in FIG. 1, a guide shaft 7 has a substantially columnar shape. Rubber feet 9 integrated with this guide shaft 7 are formed at the two ends of its lower portion. The upper portion of the guide shaft 7 is cut off over the entire length in the longitudinal direction (the direction of an arrow A). The magnetic encoder 20 is bonded to this cut-off portion. Upon printing, this guide shaft 7 is slidably inserted into a guide hole 15 formed in the housing 3.

A roller 4 is rotatably attached to the housing 3. The roller 4 and the two rubber feet 9 formed at the two ends of the guide shaft 7 are in contact with the surface of a desk or the like on which the sheet 41 is placed. The clearance between the nozzle surface of the built-in printhead of the housing 3 and the sheet 41 is held constant by the two rubber feet 9 and the roller 4. The housing 3 further has three rotatable spurs 17. During printing, these spurs 17 slightly push the sheet 41 downward by a spring shaft (not shown).

This printing apparatus prints by scanning the housing 3 once in the direction of the arrow A and then moving the housing 3 in the direction of an arrow B.

Figure 2:
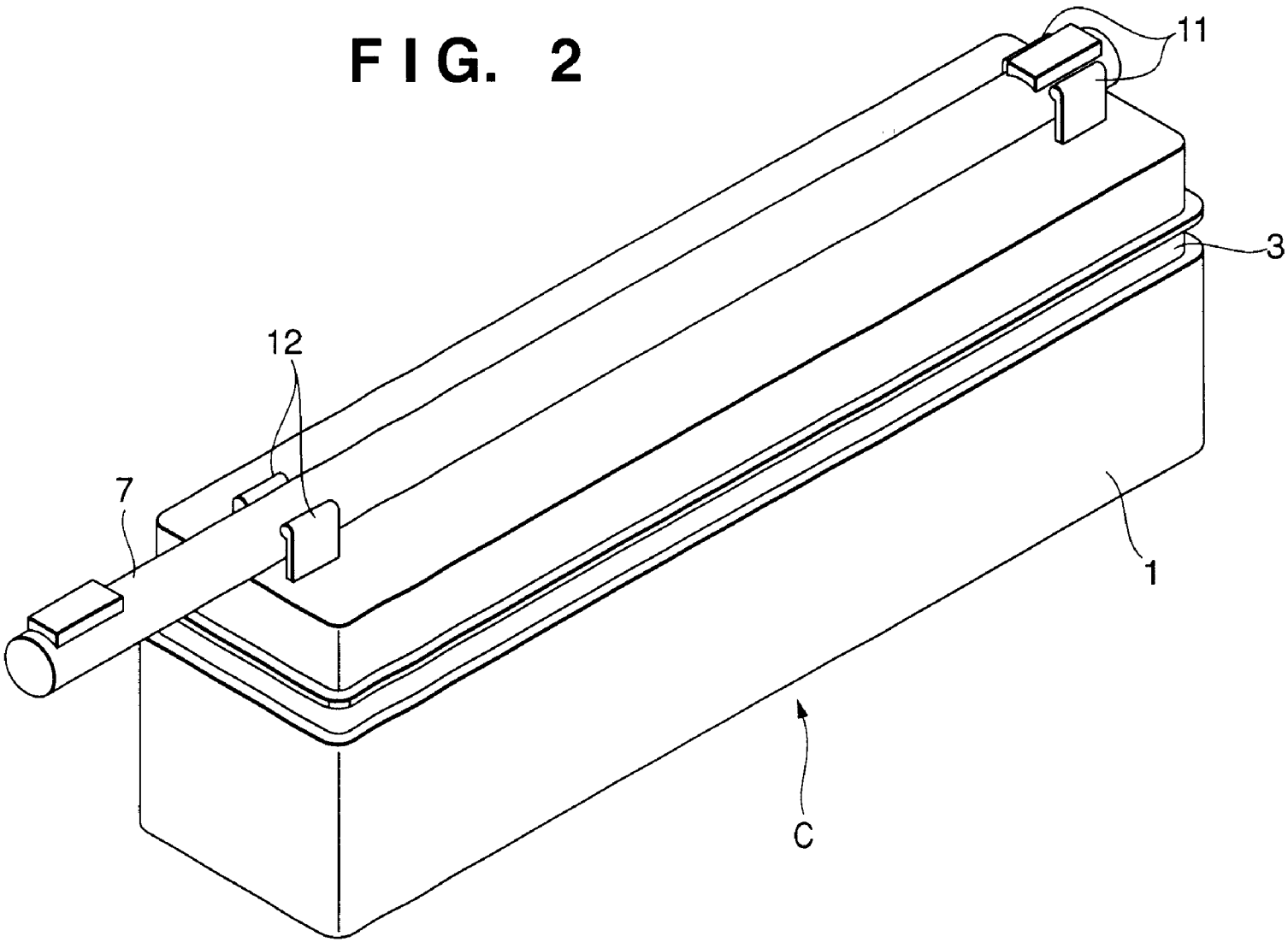
FIG. 2 is a perspective view showing the state in which the printing apparatus shown in FIG. 1 is carried.
Figure 3:
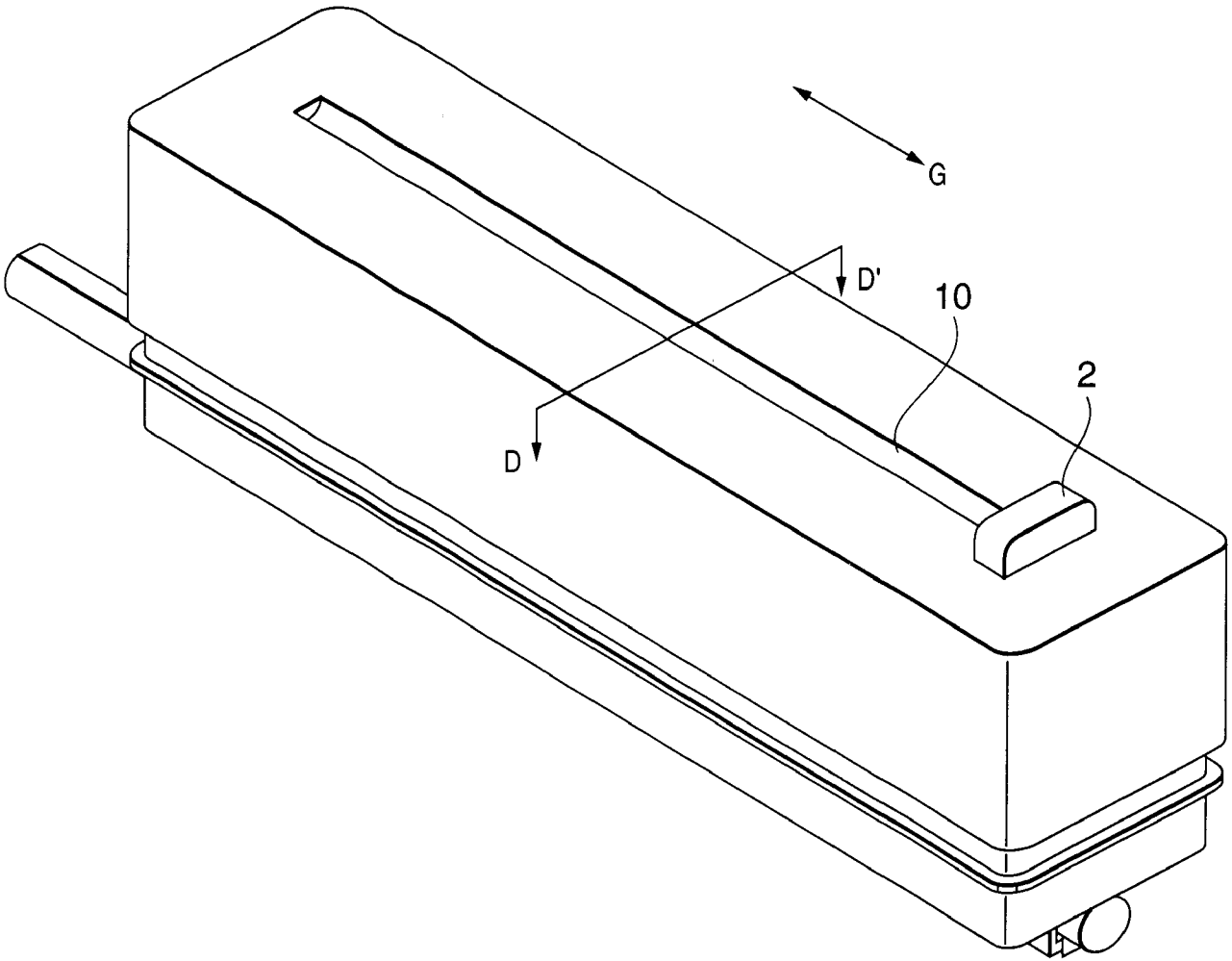
FIG. 3 is a perspective view showing the state in which the printing apparatus shown in FIG. 1 is carried.

FIGS. 2 and 3 are perspective views showing the state in which the printing apparatus shown in FIG. 1 is carried.

As shown in FIG. 2, claws 11 and 12 integrated with the housing 3 are formed on the upper portion of the housing 3. When the printing apparatus is carried, these claws 11 and 12 hold the guide shaft 7. When printing is to be performed, the guide shaft 7 is detached from the claws 11 and 12, and the cap 1 is attached to the housing 3 so as to cover these claws 11 and 12.

FIG. 3 shows a perspective view when the printing apparatus shown in FIG. 2 is viewed in the direction of an arrow C.

Figure 4:
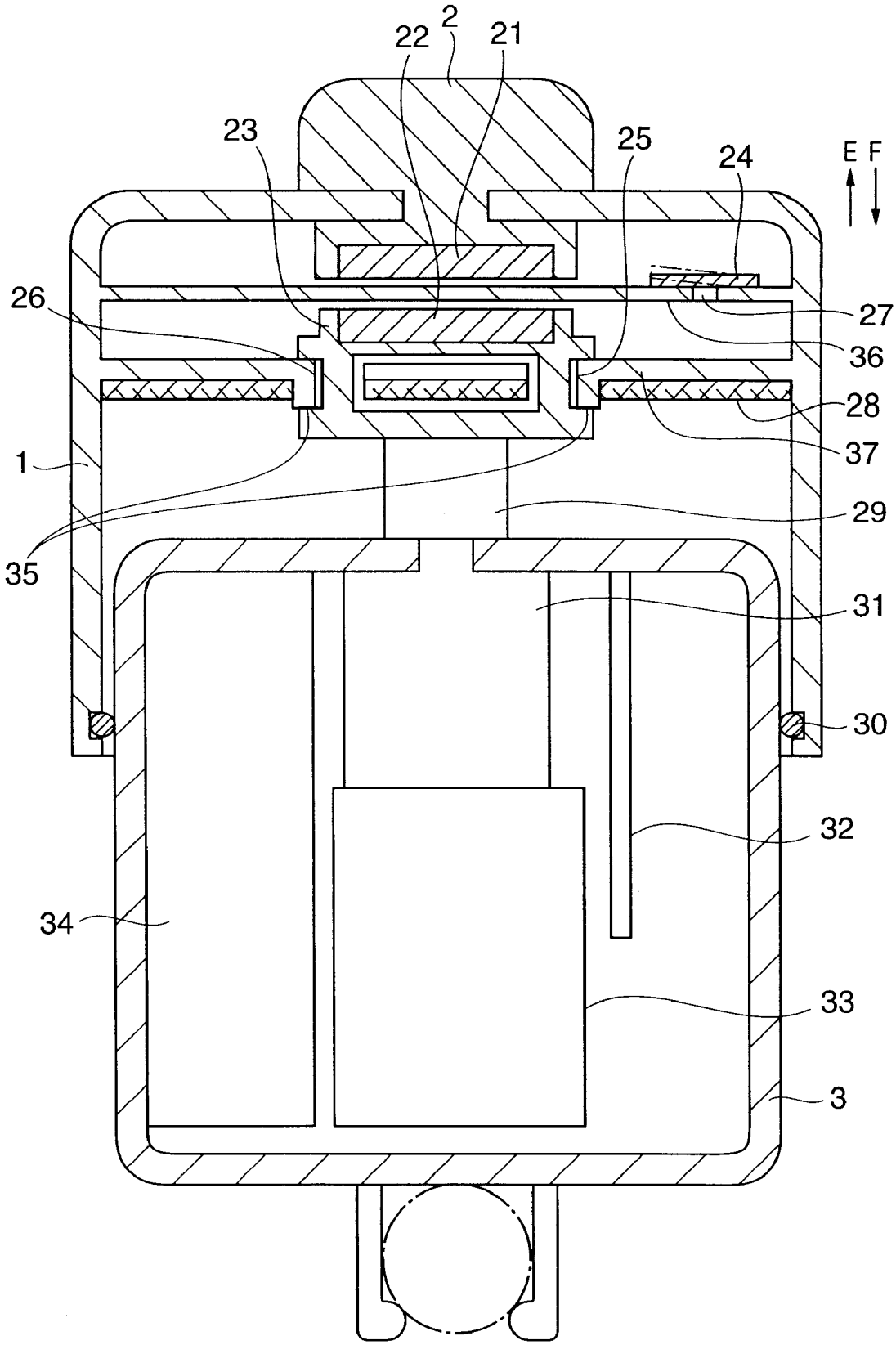
FIG. 4 is a sectional view when a lever 2 is moved to the center of a groove 10 and the printing apparatus is cut along an arrow D-D'.

FIG. 4 is a sectional view when the lever 2 is moved to the center of the groove 10 and the printing apparatus is cut along an arrow D-D'.

As shown in FIG. 4, a wall 37 is formed in the cap 1, and two guide portions 35 parallel to the groove 10 are formed on the wall 37. A wiper holder 23 slidably engages with these guide portions 35 via notches 25 and 26. A magnet 22 is integrated with this wiper holder 23. Another magnet 21 is embedded in the lower portion of the lever 2. These magnets 21 and 22 are so disposed that different polarities oppose. Accordingly, the lever 2 moves along the groove 10 as the magnets 21 and 22 attract each other. Consequently, the wiper holder 23 also moves along the guides 35.

A wiper 29 is integrated with the wiper holder 23. This wiper 29 is made of a rubber material such as HNBR and has the shape of a flat plate with a thickness of about 0.6 mm. The wiper 29 is so designed that its end portion abuts against the ink discharge surface of a printhead 31 when the cap 1 and the housing 3 are in predetermined positions. Therefore, dust, ink, and the like sticking to the ink discharge surface of the printhead 31 can be removed by the end portion of the wiper 29 by moving the lever 2.

A hole (not shown) is formed near one end portion of the housing 3. The removed dust, ink, and the like are swept downward through this hole by the wiper 29. Furthermore, an absorber 28 is adhered to the bottom of the wall 37 to absorb or adsorb the dust, ink, and the like swept downward.

In addition, a wall 36 having a hole 27 is formed in the cap 1. In normal state, a valve 24 for closing the hole 27 is attached to this wall 36. Also, a packing 30 provided in the inner circumferential surface of the cap 1 is in close contact with the housing 3. Therefore, by moving the cap 1 in the direction of an arrow E, a negative pressure can be generated in the space on the ink discharge surface of the print head 31. When the cap 1 is moved in the opposite direction, i.e., the direction of an arrow F, the valve 24 moves as indicated by the alternate long and short dashed line in FIG. 4. Since this opens the hole 27, no negative pressure is generated.

The housing 3 contains the printhead 31 for discharging ink and an ink tank 33 for supplying ink to the printhead 31. This printhead 31 has 360 ink discharge nozzles (to be referred to as nozzles hereinafter) per inch and has a total of 1,200 nozzles in the longitudinal direction (the direction of an arrow G in FIG. 3) of the housing 3. As described above, the housing 3 also has the PCB 32 for controlling output of a discharge signal supplied to the printhead 31 and controlling signal exchange with an external apparatus, and the power supply for supplying power to the printhead 31 and the PCB 32.

Figure 5:
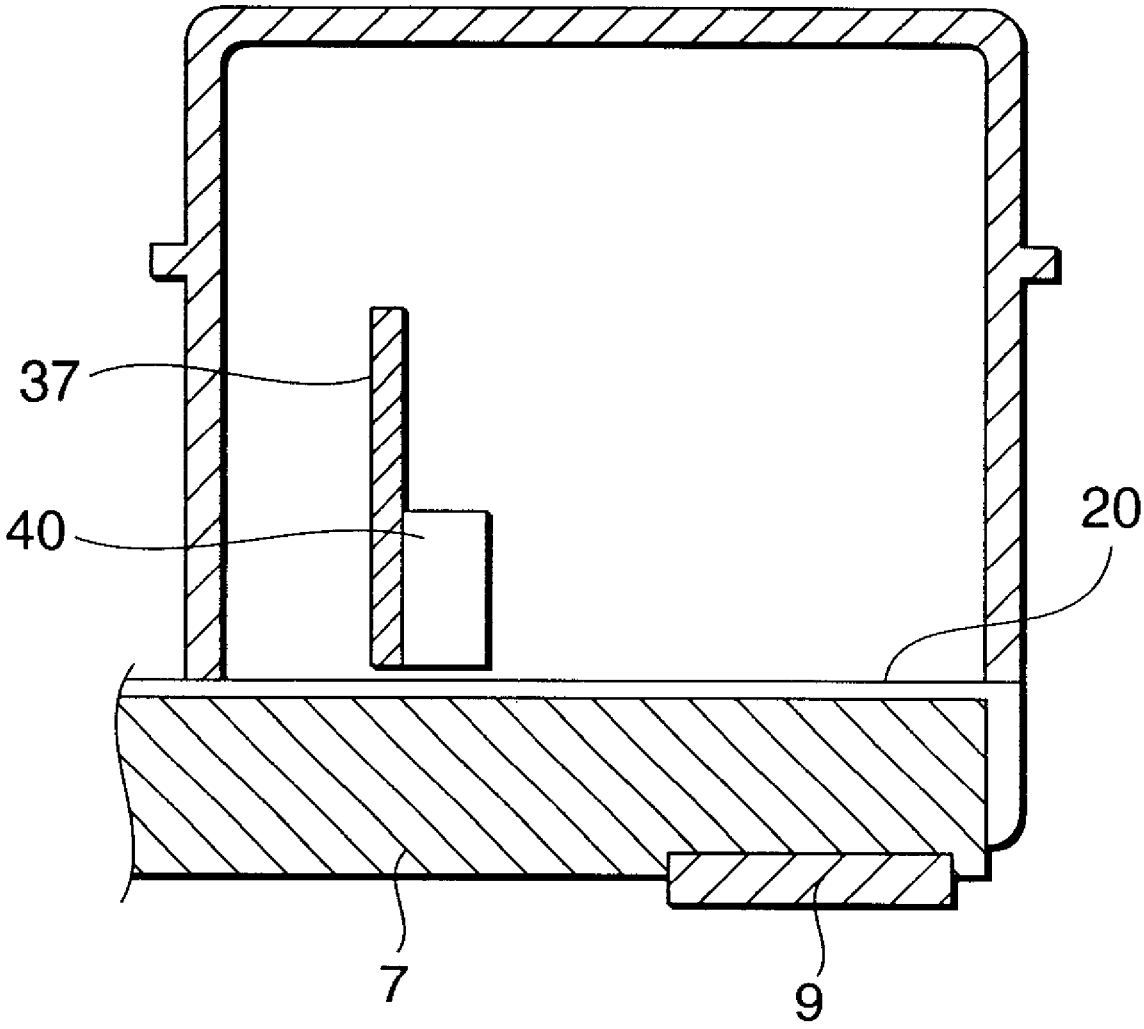
FIG. 5 is a sectional view of a portion of a housing 3, where a guide shaft 7 is inserted into a guide hole 15.

FIG. 5 is a sectional view of a portion of the housing 3, where the guide shaft 7 is inserted into the guide hole 15.

As shown in FIG. 5, the sensor 40 is mounted on a PCB 37 fixed to the housing 3. This sensor 40 senses the moving amount of the housing 3 by reading a magnetic signal from the encoder 20.

Figure 6:
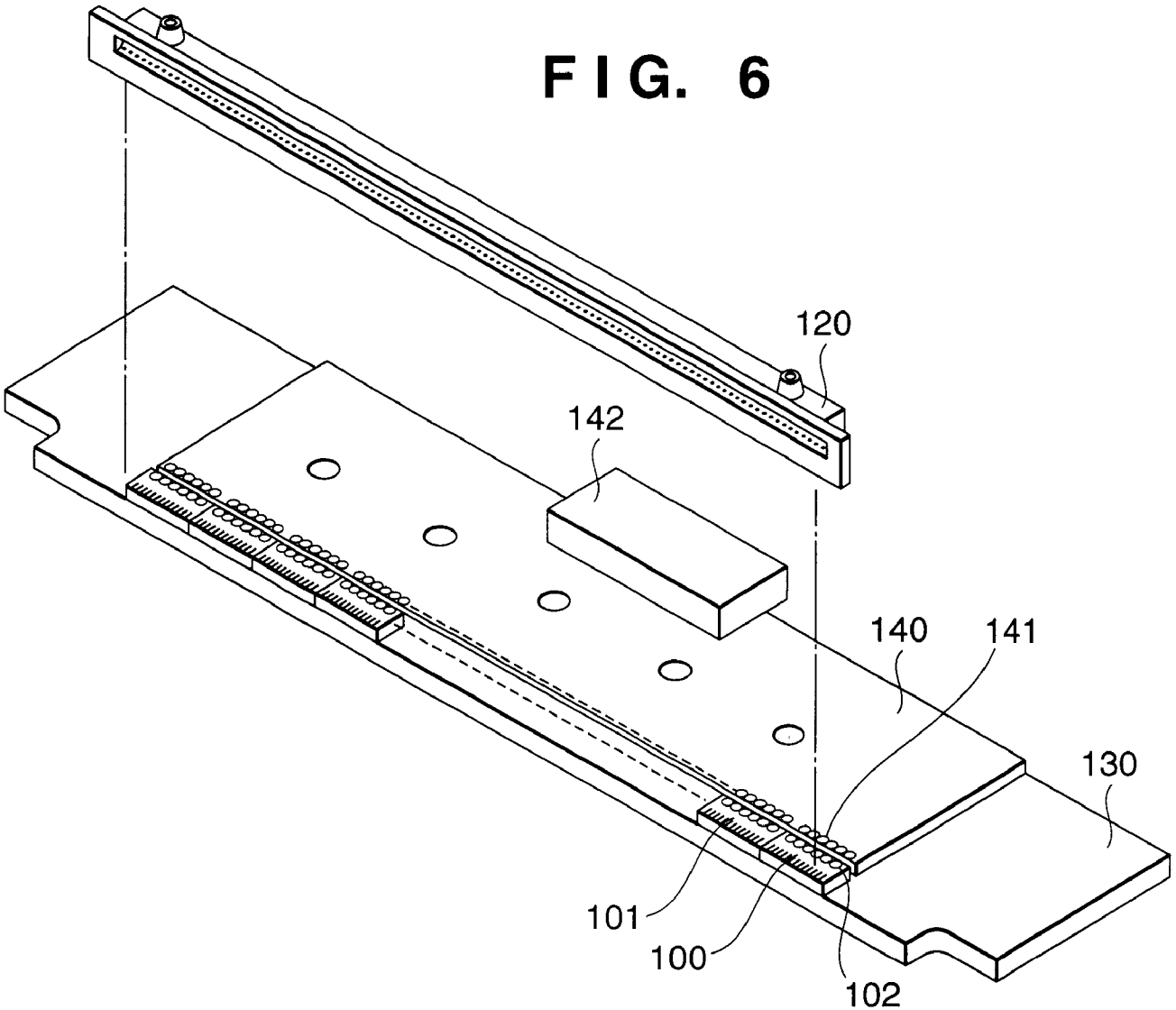
FIG. 6 is a schematic perspective view showing the construction of a printhead 31.

FIG. 6 is a schematic perspective view showing the construction of the printhead 31.

In this embodiment, the density of ink discharge orifices is 360 dpi (70.5 $\mu$m pitch), and the number of nozzles is 1,200 (print width 85 mm).

As shown in FIG. 6, discharge energy generating elements (to be referred to as printing elements hereinafter) 101 are arrayed at a density of 360 dpi on each element board 100 (to be referred to as a heater board hereinafter). The board configuration will be described later. This heater board 100 is fixed by an adhesive on the surface of a supporting body (base plate) 130 made of a metal or ceramics.

Figure 7:
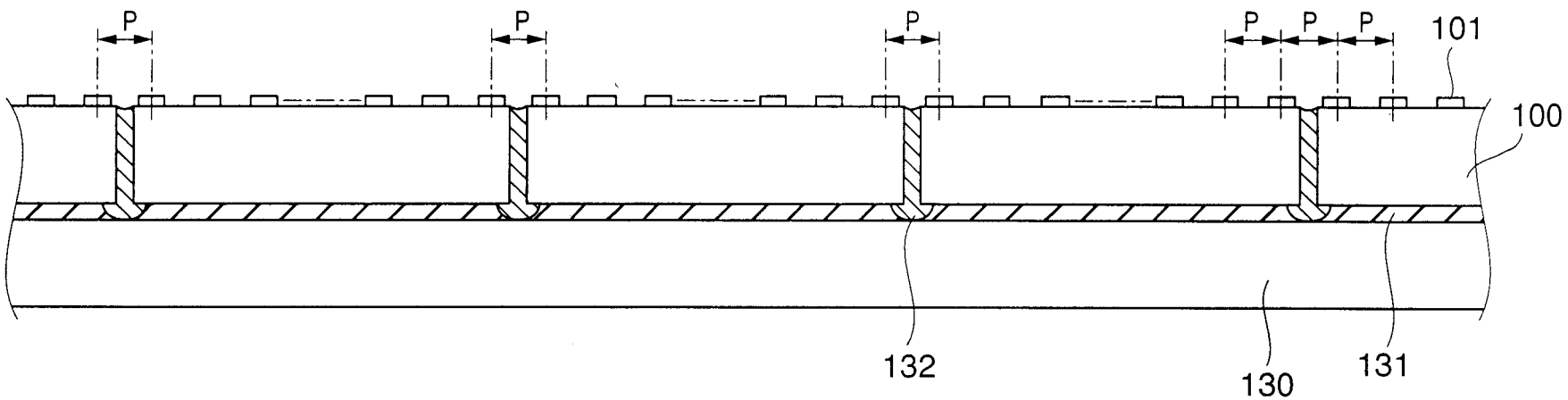
FIG. 7 is a view showing details of the state in which a plurality of heater boards 100 are arranged on a base plate 130.
Figures 8A, 8B, 8C, 8D:
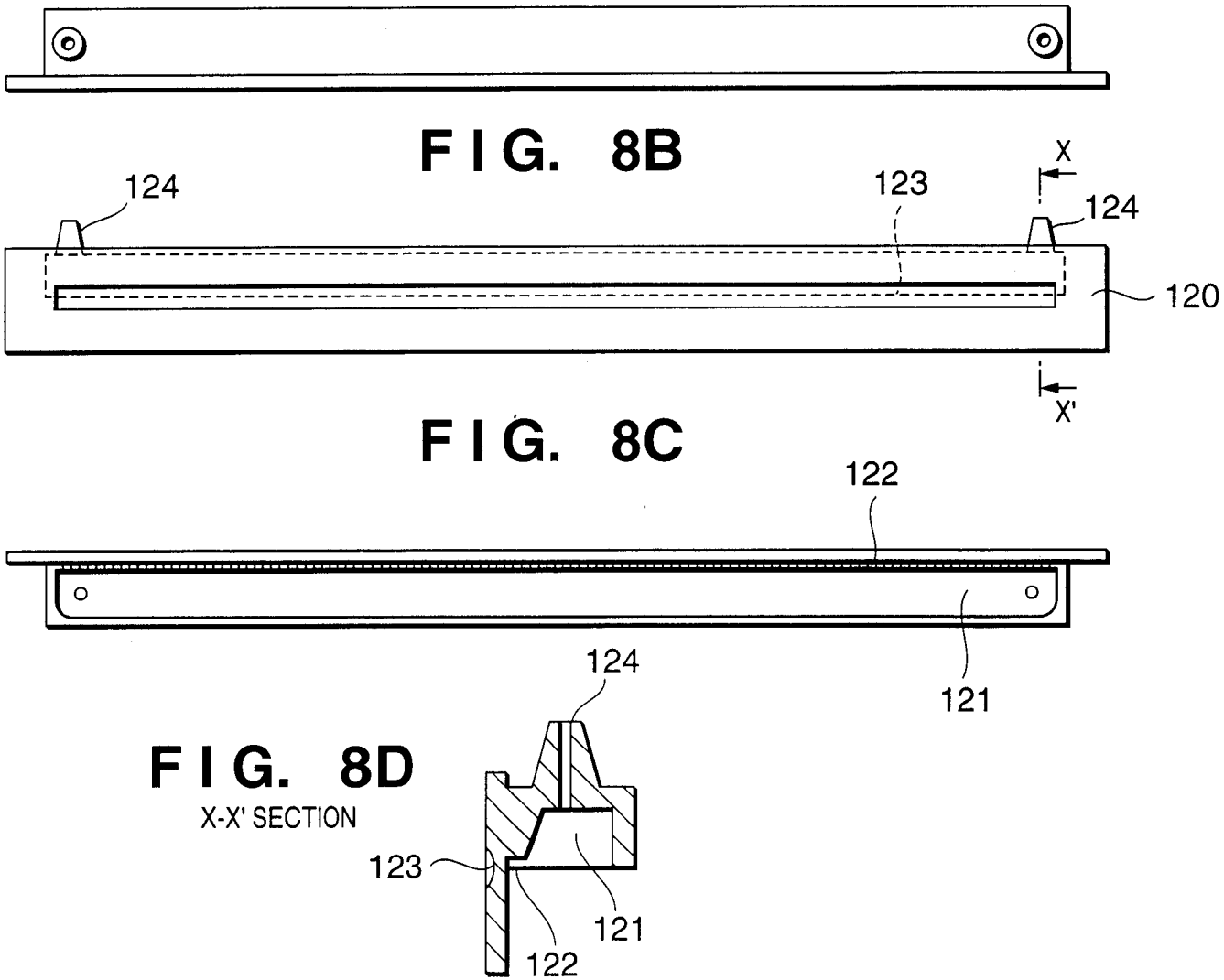
FIGS. 8A, 8B, 8C, and 8D are a top view, front view, bottom view, and sectional view, respectively, of a top plate 120.

FIG. 7 is a view showing details of the state in which a plurality of heater boards 100 are arranged on the base plate 130. As shown in FIG. 7, these heater boards 100 are fixed by adhesion on predetermined positions of the base plate 130 by an adhesive 131 which is applied to have a predetermined thickness. That is, these heater boards 100 are accurately adhered such that the pitch between two end printing elements 101 of two adjacent heater boards 100 is the same as the array pitch (P=70.5 $\mu$m) of the printing elements 101 arranged on each heater board 100. The gaps between the heater boards can be left unattended if no ink leaks from them. In this embodiment, however, these gaps are sealed with a sealant 132.

Referring to FIG. 6, a wiring board 140 is adhered to the base plate 130 similar to the heater boards 100. The wiring board 140 is so adhered that connection pads 102 on the heater boards 100 and signal-power supply pads 141 formed on the wiring board 140 have a predetermined positional relationship. The wiring board 140 has a connector 142 for receiving a printing signal from an external apparatus and receiving driving power supply.

A top plate 120 as a grooved member having grooves for forming ink channels will be described below.

FIGS. 8A to 8D are a top view, front view, bottom view, and X-X' sectional view, respectively, of the top plate 120.

As shown in FIGS. 8A to 8D, the top plate 120 comprises channels 122, orifices 123, a liquid chamber 121, and ink supply ports 124. The channels 122 are formed in one-to-one correspondence with the printing elements 101 formed on the heater boards 100. The orifices 123 are formed in one-to-one correspondence with these channels 122 to communicate with them and discharge ink toward a printing medium. The liquid chamber 121 communicates with the channels 122 so as to supply ink to them. The ink supply ports 124 supply ink to the liquid chamber 121 from the ink tank (not shown). The top plate 120 has a length which substantially covers the printing element row formed by arranging a plurality of heater boards 100.

As shown in FIG. 6, the top plate 120 connects the channels 122 to the printing elements 101 on the heater boards 100 arranged on the base plate 130 such that these channels and printing elements have a predetermined positional relationship.

Figure 9:
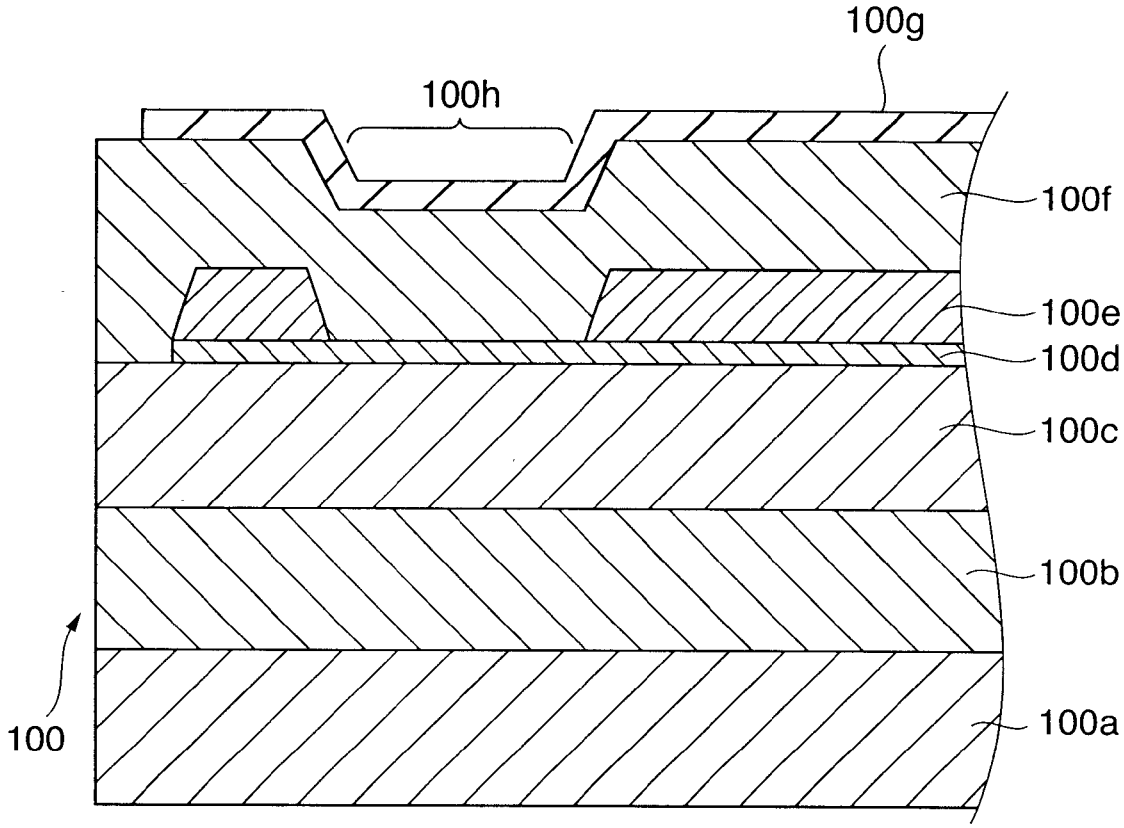
FIG. 9 is a sectional view showing an ink channel portion of the heater board 100 of the printhead 31.

FIG. 9 is a sectional view showing an ink channel portion of the heater board 100 of the printhead 31.

As shown in FIG. 9, a thermal oxide film 100*b* as a heat storage layer and an interlayer film 100*c* made from silicon dioxide ($SiO_2$) or silicon nitride ($Si_3N_4$) and also serving as a heat storage layer are stacked on a silicon substrate 100*a* as a base of the heater board 100. In addition, a resistance layer 100*d* and a wiring portion 100*e* made of Al or an Al alloy such as Al—Si or Al—Cu are formed by patterning on the interlayer film 100*c*. On the resistance layer 100*d* and the wiring portion 100*e*, a protective layer 100*f* made from silicon oxide ($SiO_2$) or silicon nitride ($Si_3N_4$) and a cavitation-resistant layer 100*g* are stacked. The cavitation-resistant layer 100*g* protects the protective layer 100*f* from chemical or physical shocks produced by heat generated from the resistance layer 100*d*. The resistance layer 100*d* and the wiring portion 100*e* form a heating layer. A region on the resistance layer 100*d* where the wiring portion 100*e* is not formed is a thermally acting portion 100*h* which functions as a heating element. As described above, the resistance layer 100*d* and the thermally acting portion 100*h* formed on the silicon substrate 100*a* by semiconductor manufacturing technology form a heating unit.

Figure 10A:
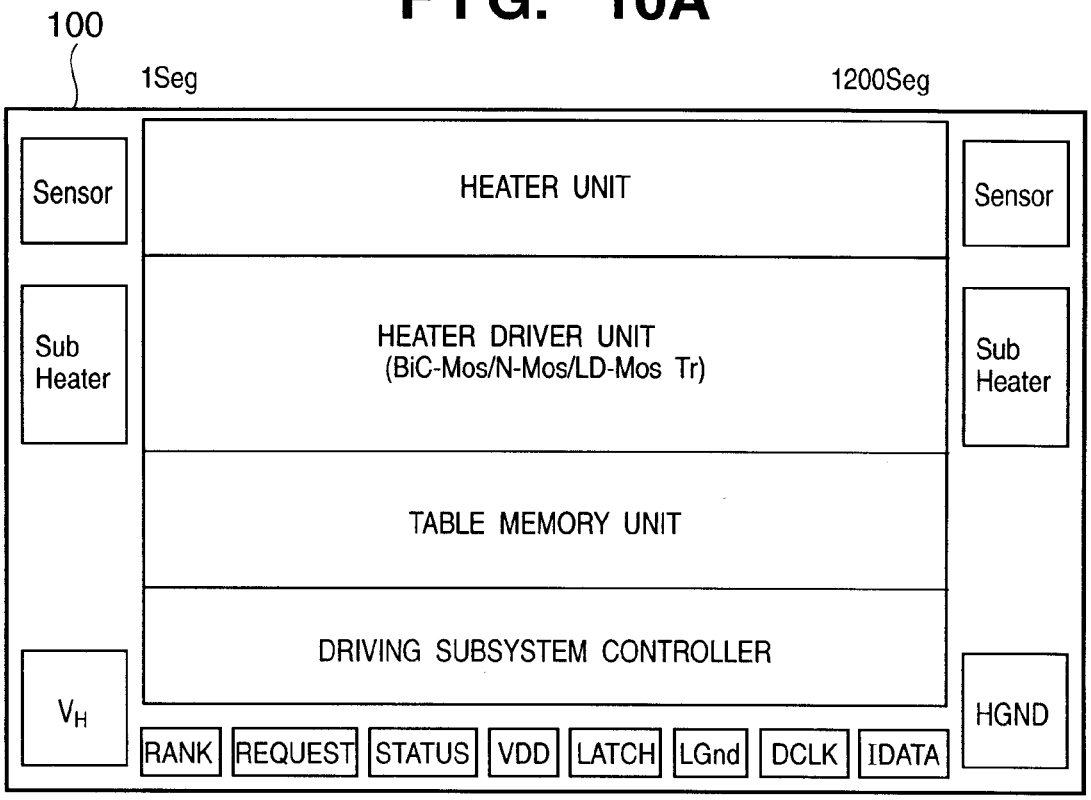
FIGS. 10A and 10B are block diagrams showing an outline of the functional configuration of the heater board 100.
Figure 10B:
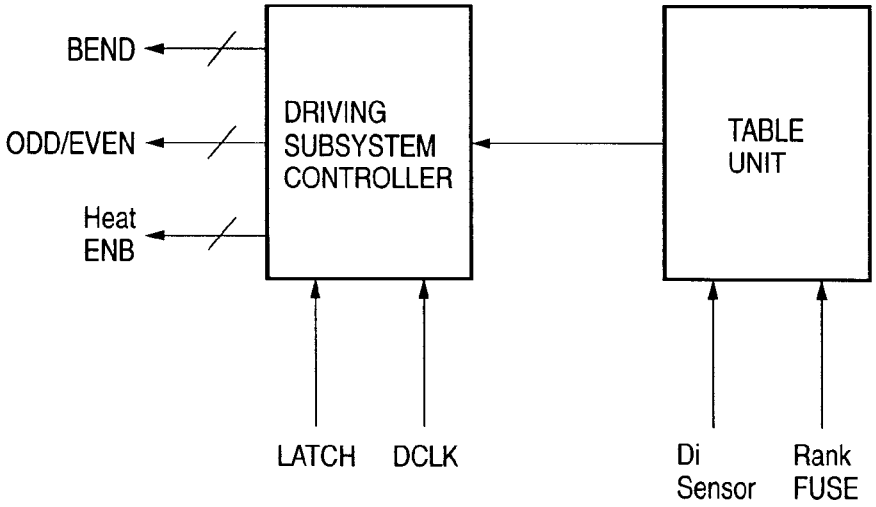

FIGS. 10A and 10B are block diagrams showing an outline of the functional arrangement of the heater board 100.

FIG. 10A shows an overall functional configuration of the heater board 100. FIG. 10B shows the relationship between a driving subsystem controller and a table unit.

In FIG. 10A, reference symbol $V_H$ denotes a heater driving power pad for receiving power from the printing apparatus main body; HGND, a power ground pad; VDD, a logic power pad; and LGnd, a ground pad for the logic power supply VDD. A heater unit and a heater driver unit are connected by electrical lines (not shown). The heater unit includes a plurality of heating elements used for discharging liquid by generating bubbles by using thermal energy. The heater driver unit includes heater drivers arranged in one-to-one correspondence with these heating elements to drive the corresponding heating elements in accordance with image data.

The heater driver unit has a shift register and latch circuit. The shift register serially receives image data via a pad (IDATA), temporarily stores the data, and outputs the data in parallel in one-to-one correspondence with the heating elements. The latch circuit temporarily stores the output data from this shift register. The heater driver unit also has an AND circuit which receives a block-select signal (BENB), an even-number/odd-number division signal (ODD/EVEN), and a driving pulse signal (HeatENB), and calculates the logical product of these signals. The block-select signal (BENB) is used for driving printing elements by dividing them into blocks. The even-number/odd-number division signal (ODD/EVEN) is used for dividing printing elements arranged in adjacent ink channels so that these printing elements are not simultaneously driven. The driving pulse signal (HeatENB) is used for driving printing elements on the basis of image data. As shown in FIG. 10B, the driving subsystem controller for generating these block-select signal (BENB), even-number/odd-number division signal (ODD/EVEN), and driving pulse signal (HeatENB) receives a clock for driving the shift register via a pad (DCLK) and a latch signal via a pad (LATCH).

As shown in FIG. 10B, the table unit receives a read signal (DiSensor) from a temperature sensor (Sensor) of the heater board 100 and a read signal (RankFUSE) from a heater resistance monitoring heater or a fuse. The table unit transmits tables corresponding to these input values to the driving subsystem controller. Furthermore, this table unit is connected to a temperature adjusting subheater (SubHeater) and adjusts the heater board temperature in accordance with the read signal from the temperature sensor.

Also, in response to a status signal input from the printing apparatus main body via a pad (STATUS), the table unit returns, to the printing apparatus main body, the function and status of the printhead as a request signal via a pad (REQUEST) and as a rank signal via a pad (RANK).

These circuits are formed on a silicon substrate by semiconductor technologies, and the thermally acting portion 100*h*, described earlier, is also formed on the same substrate.

Figure 11A:
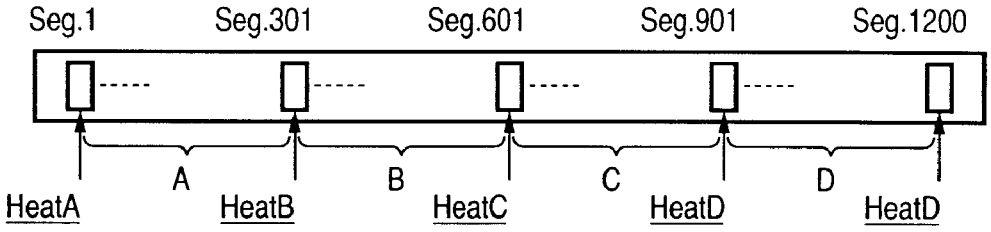
FIG. 11A is a view showing the array of printing elements of the printhead 31 in which 1,200 printing elements are arranged.
Figure 11B:
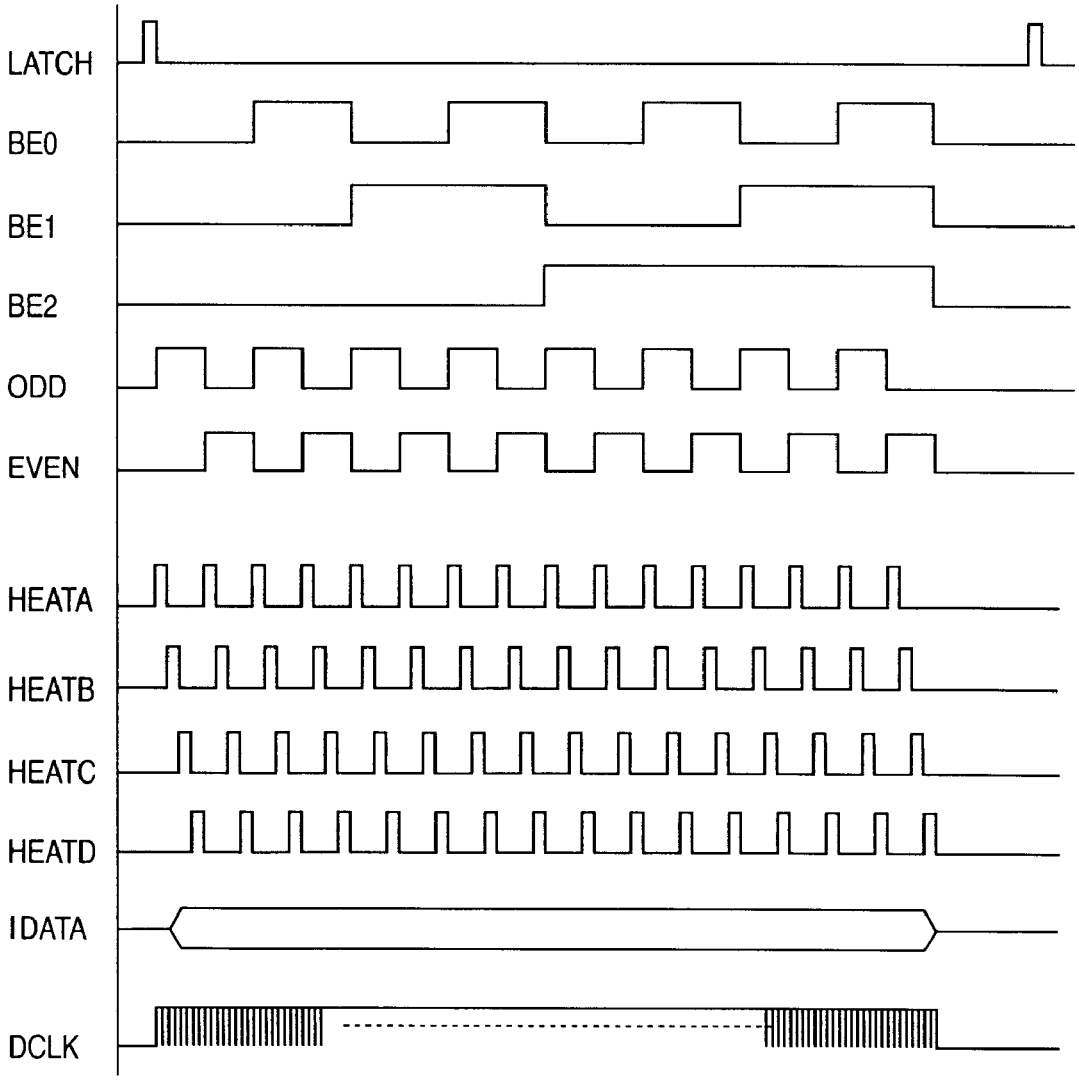
FIG. 11B is a timing chart showing various signals used in this printhead.

FIG. 11A shows the printing element array of the print head 31 in which 1,200 printing elements are arranged. FIG. 11B is a timing chart showing various signals used in this printhead.

As shown in FIG. 11A, these 1,200 printing elements are divided into four groups A to D, and driving pulse signals are input to these groups at the same timing. That is, a signal [HEATA] is input as a driving pulse signal to printing elements from Seg.1 to Seg.300; a signal [HEATB] is input as a driving pulse signal to printing elements from Seg.301 to Seg.600; a signal [HEATC] is input as a driving pulse signal to printing elements from Seg.601 to Seg.900; a signal [HEATD] is input as a driving pulse signal to printing elements from Seg.901 to Seg.1200. In this embodiment, the reference value of a signal pulse width input as each driving pulse signal is 2.0 $\mu$sec.

As shown in FIG. 11B, in order not to input the driving pulse signal to the 300 printing elements in each group at the same time, these printing elements are divided into eight groups by block-select signals [BE0], [BE1], and [BE2].

Furthermore, the driving pulse signals (HEATA to HEATD) are slightly delayed from each other so that these driving pulses are not input at the same timing. This delay value is divided into four parts in accordance with the pulse period of the latch signal (LATCH) and so controlled that no input pulses overlap. For example, when the moving velocity of the manually moved printing apparatus is 1.0 kHz, one period of the latch signal is 1,000 $\mu$sec. This period is input into the driving subsystem controller of the printhead from an encoder placed in a control subsystem of the printing apparatus. On the basis of this period and the read values from the temperature sensor and rank heater arranged in the printhead, an optimum driving pulse width and a delay value between driving pulses in each group are calculated. This can suppress an electric current instantaneously flowing through the lines of the heater driving power supply $V_H$ and the power supply ground HGND.

Figure 12:
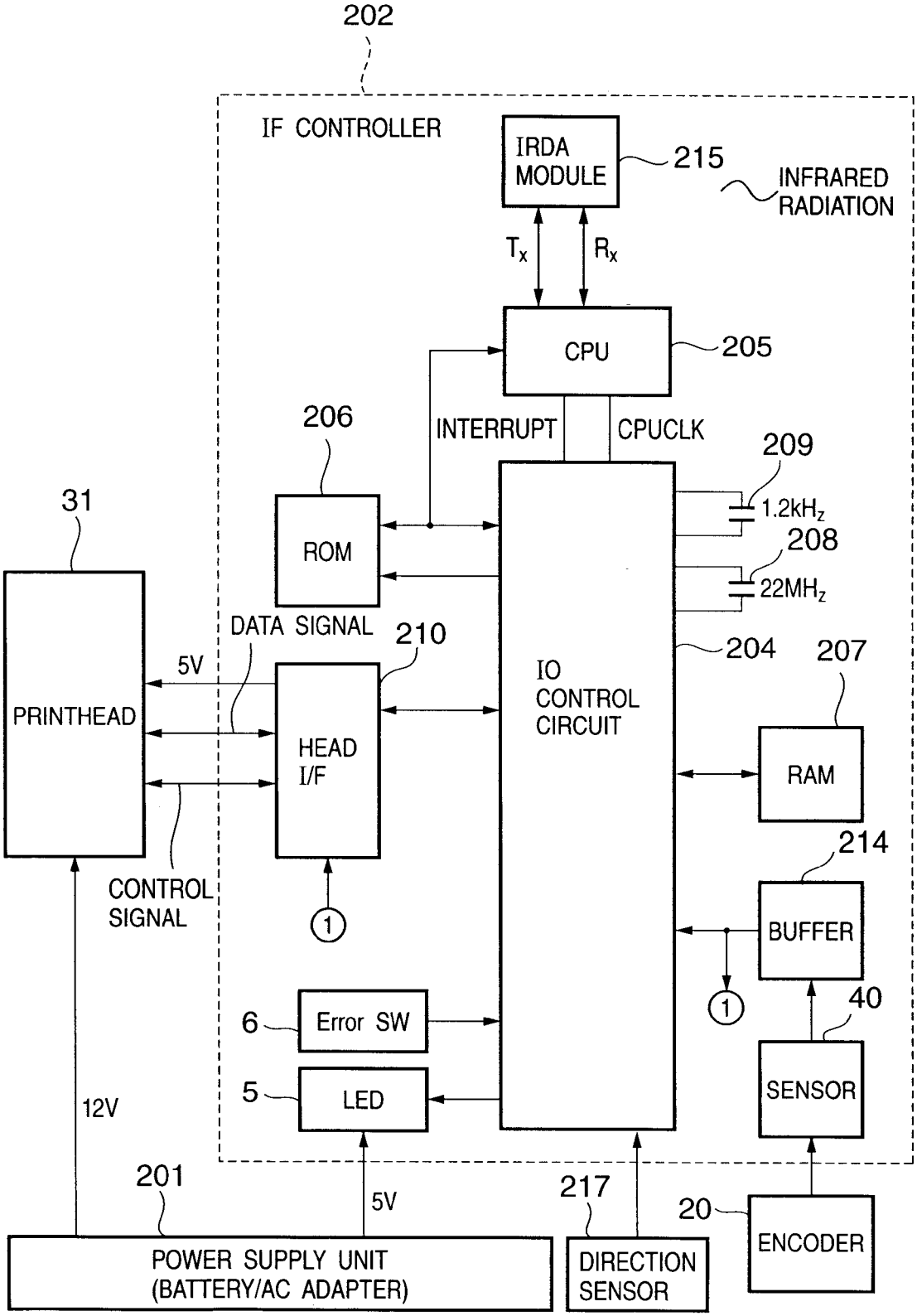
FIG. 12 is a block diagram showing the control configuration of the printing apparatus.

FIG. 12 is a block diagram showing the control configuration of the printing apparatus.

As shown in FIG. 12, a control circuit of this printing apparatus comprises a power supply unit 201, an IF controller 202, and the printhead 31.

When the printing apparatus receives printing information from an external apparatus such as a personal computer (not shown), this printing information is temporarily stored in the IF controller 202 and at the same time converted into data processable in the printing apparatus. This data is input to a CPU 205 for controlling signal supply to the printhead. On the basis of control programs stored in a ROM 206, the CPU 205 processes the input data in cooperation with peripheral circuits such as a RAM 207 and converts the data into image data (IDATA).

The ROM 206 stores various control programs for executing protocol control for communicating with an external apparatus such as a personal computer and for executing printing apparatus moving velocity detection control. The CPU 205 reads out these control programs from the ROM 206 and executes them. The RAM 207 is a memory having areas such as a work area used as a register, a data buffer area for storing printing data, and a buffer area for signals exchanged with an IRDA module 215 as an infrared communication interface.

This printing apparatus communicates with an external apparatus such as a personal computer via the infrared communication interface. More specifically, the CPU 205 executes the code of a communication control program stored in the ROM 206, thereby executing asynchronous infrared communication in accordance with a predetermined protocol while controlling the IRDA module 215. A printing instruction and printing data communicated via the IRDA module 215 are exchanged as a transmission signal Tx and a reception signal Rx between the CPU 205 and the external apparatus.

Also, to print an image in an appropriate position on a printing medium on the basis of the image data, the CPU 205 generates a sync signal [LATCH] for driving the printhead, in synchronism with the image data and the moving velocity of the printing apparatus. The image data and the sync signal are transmitted to the printhead 31 via a head interface (head I/F) 210, and the printhead 31 is driven at controlled timings to print the image.

To perform this printing operation, an IO control circuit 204 reads out printing data as sequential dot images stored in the RAM 207, and transfers the readout printing data to the printhead 31 by controlling the head I/F 210 at appropriate timings.

The power supply unit 201 is a main power supply of the printing apparatus and supplies AC power or electric power from a rechargeable battery known as a nickel-cadmium (NiCd) power supply. This power supply unit 201 supplies a voltage of 12 V to the printhead 31 and a voltage of 5 V to the IF controller 202.

To support communication (data exchange) between the printhead 31 for actually printing data and an external apparatus such as a personal computer as a transmission source of printing data, the IF controller 202 performs data buffering, exchanges control signals with the external apparatus, controls communication, controls power saving, controls an external switch and an indicator (LED or the like) as a user interface, and controls detection of the moving velocity of the printing apparatus. To do this, the IF controller 202 includes the IO control circuit 204, the CPU 205, the ROM 206 for storing control programs, the RAM 207 which the CPU 205 uses as a work area for performing various processes and control, local oscillators 208 and 209 for oscillating basic clocks at frequencies of 22 MHz and 1.2 kHz, and the head I/F 210 for buffering signals exchanged with the printhead 31.

The head I/F 210 supplies power to the printhead at a voltage of 5 V as a logic power supply. Furthermore, the head I/F 210 is connected to the printhead 31 by a data signal line for supplying printing data to the printhead and by a control signal line for transferring various control signals for controlling a data signal.

The IF controller 202 also includes the switch 6 for power supply control and on line/off line control, and the LED 5 capable of indicating the condition of the network, the condition of the power supply, and the status of the printing apparatus. The IO control circuit 204 performs all these control operations. To detect the moving velocity of this printing apparatus, the apparatus further comprises the encoder 20 capable of detecting the moving amount of the printing apparatus via the roller 4 by which the printing apparatus is moved by a user, and a buffer 214 for storing the detection pulse.

As shown in FIG. 12, this embodiment includes the sensor 40 and a sensor (Direction sensor) 217. The sensor 40 senses the moving velocity and moving amount of the printing apparatus by reading the magnetic signal from the encoder 20, and outputs the sensed moving velocity and moving amount to the buffer 214. The sensor 217 senses the moving direction of the printing apparatus in a printable state. The sensor 217 is interlocked with the movement of the roller 4 to output an electrically "HIGH" signal when the printing apparatus is moving in a printing direction, and output a "LOW" signal when the apparatus is moving in the opposite direction.

The control programs stored in the ROM 206 include programs for executing power saving control by which the apparatus is changed to a power saving mode or returned to a normal printing mode in accordance with the condition of the housing 3, and for controlling change/stop of an operating clock.

Figure 13:
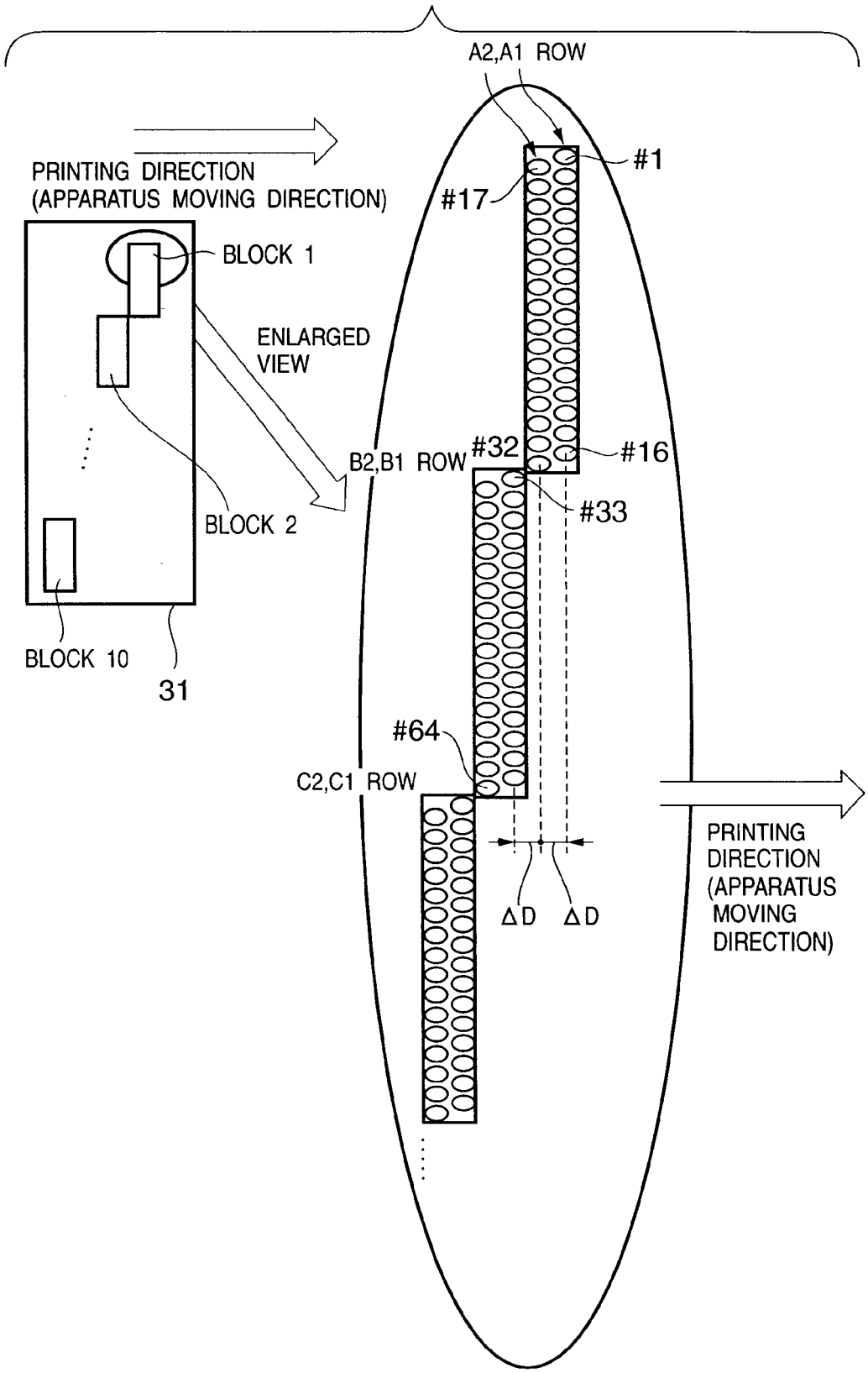
FIG. 13 is a view showing the shape of the array of ink discharge orifices of the printhead 31.

FIG. 13 is a view showing the array shape of the ink discharge orifices of the printhead 31 used in this embodiment.

As explained previously, the printhead 31 has 1,200 ink discharge orifices from an ink discharge orifice #1 to an ink discharge orifice #1200. In this embodiment, the printhead 31 further includes 80 auxiliary ink discharge orifices, i.e., has a total of 1,280 ink discharge orifices. So, the printhead 31 has 1,280 printing elements in one-to-one correspondence with these discharge orifices.

In this embodiment with the above arrangement, as shown in FIG. 13, the 1,280 ink discharge orifices (and the 1,280 printing elements) are divided into 10 blocks (block 1 to block 10) each including 128 ink discharge orifices (and 128 printing elements). Printing elements in each block are formed on one heater board. As shown in FIG. 13, these 10 heater boards are arranged to be shifted one after another in the apparatus moving direction.

As shown in FIG. 13, each block has four ink discharge orifice groups each having two rows (e.g., rows A1 and A2) of 16 ink discharge orifices. In each row, ink discharge orifices are formed in a direction perpendicular to the printing direction (the moving direction of the printing apparatus). Adjacent rows are equally spaced at a distance of $\Delta D$ (in this embodiment, $\Delta D$=0.006 mm).

When the printhead having this arrangement operates, these rows are time-divisionally driven in the order of row Al, row A2, row B1, row B2, . . . , thereby reducing the instantaneous power consumption.

Figure 14:
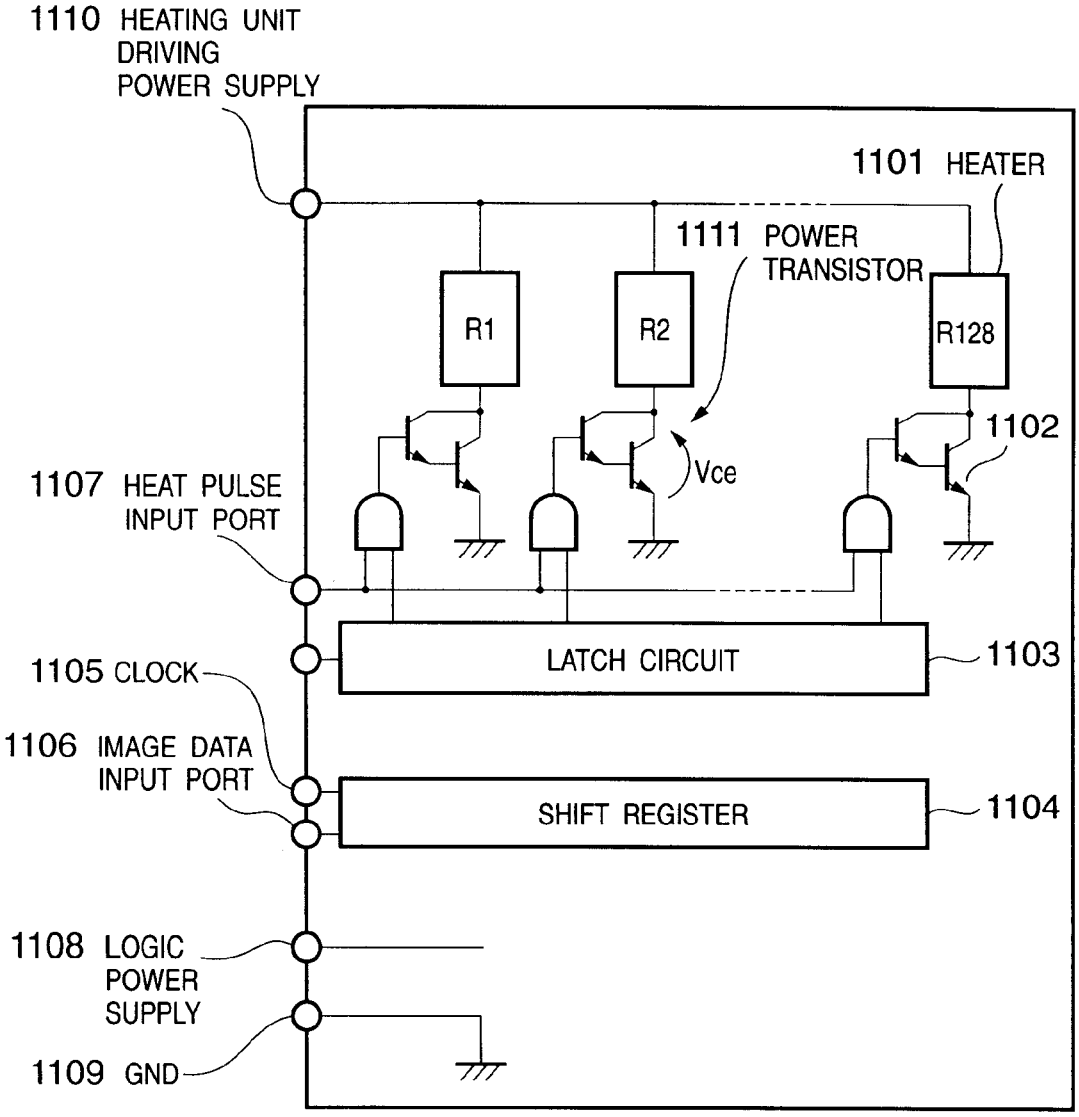
FIG. 14 is a view showing a heater board and its driving circuit in one block of the printhead 31.

FIG. 14 is a view showing a heater board and its peripheral driving circuit in one block of the printhead 31.

Referring to FIG. 14, 128 printing elements #1 to #128 in one block have numbers corresponding to the positions of ink discharge orifices formed in the heater board. Reference symbols R1 to R128 denote heating resistors (heaters) as printing elements formed in one-to-one correspondence with these ink discharge orifices #1 to #128. Reference numeral 1102 denotes a power transistor as a driver; 1103, a latch circuit; 1104, a shift register; 1105, a clock for operating the shift register 1104; 1106, an image data input port; 1107, a heat pulse input port for externally controlling the ON time of the power transistor 1102; 1108, a logic power supply; 1109, GND; 1110, a heating unit driving power supply ($V_H$); and 1111, a power transistor driving power supply ($V_{CE}$).

In the printing apparatus having the printhead which includes a printhead circuit board with the above arrangement, image data is serially input from the image data input port 1106 to the shift register 1104. This input data is temporarily stored in the latch circuit 1103. When a pulse is input from the heat pulse input port 1107 controlled by a decoder, the power transistor 1102 is turned on to drive the heating resistor. Consequently, liquid (ink) in the channel of this heating resistor driven is heated, and the ink is discharged from the ink discharge orifice for printing.

Figure 15:
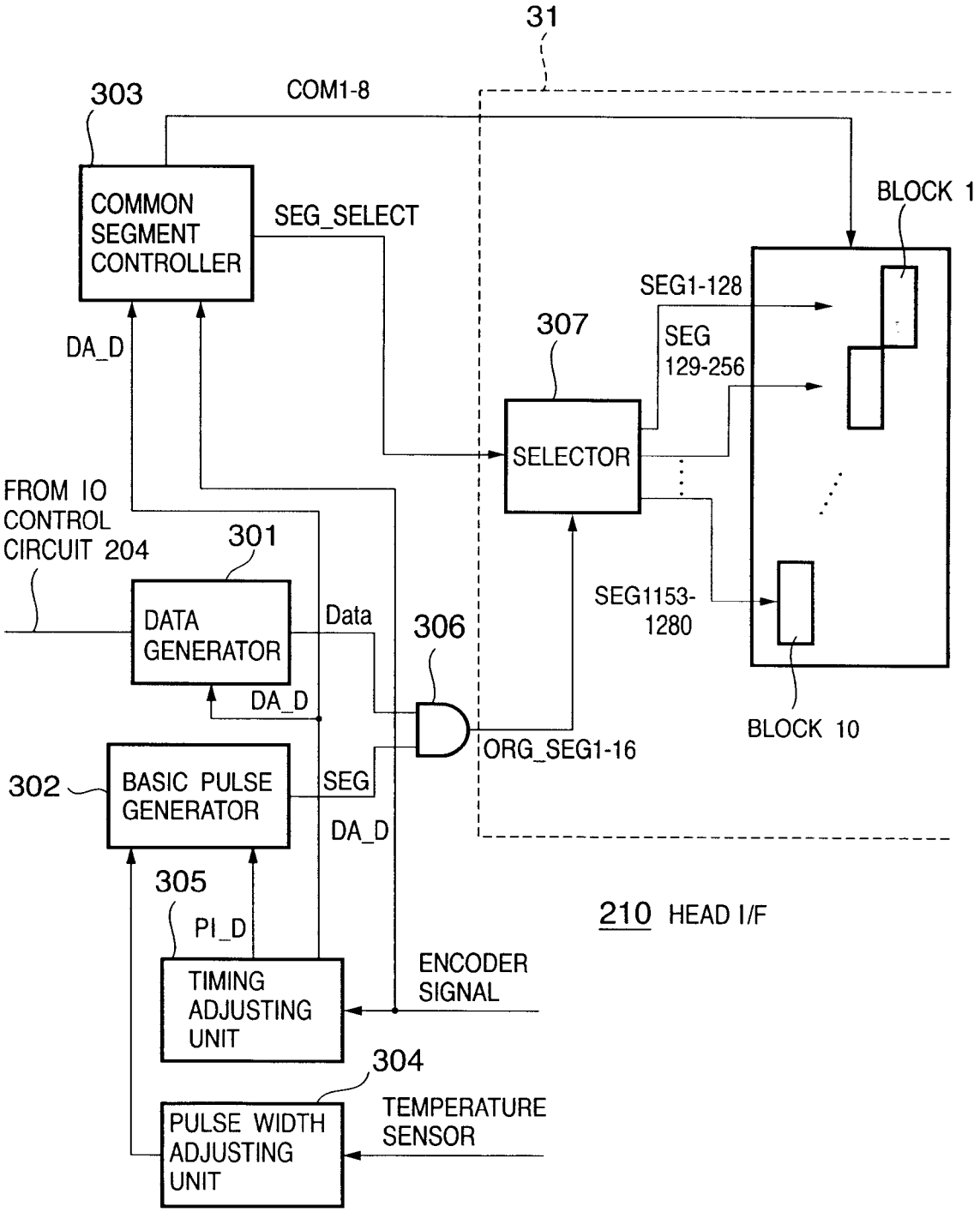
FIG. 15 is a block diagram showing the arrangement of a head I/F 210.

FIG. 15 is a block diagram showing the arrangement of the head I/F 210 for driving the printhead 31.

This head I/F 210 is composed of a data generator 301, a basic pulse generator 302, a common segment controller 303, a pulse width adjusting unit 304, a timing adjusting unit 305, and a gate circuit 306.

The timing adjusting unit 305 receives an encoder signal from the sensor 40 and generates sync signals DA_D and PI_D for driving the rows A1, A2, B1, B2, C1, . . . , of the printhead 31 in accordance with the encoder signal. The sync signal PI_D controls the basic pulse generator 302. The sync signal DA_D controls the data generator and the common segment controller 303.

The pulse width adjusting unit 304 controls the pulse width of an output signal from the basic pulse generator 302. The pulse width adjusting unit 304 adjusts the driving time (width) of the heating resistors (heaters) of the printhead 31, in accordance with the temperature-sensor (not shown) of the printing apparatus main body and the temperature-sensor (see FIG. 10A) of the printhead. The basic pulse generator 302 outputs a signal (SEG) having this adjusted pulse width, in accordance with the sync signal PI_D, to the gate circuit 306.

On the basis of printing data sequentially input from the IO control circuit 204, the data generator 301 outputs a printing signal (Data) to the gate circuit 306 in accordance with the DA_D signal. The gate circuit 306 receives the printing signal (Data) and the signal (SEG) having the adjusted pulse width, and calculates the logical product of these signals. The gate circuit 306 outputs the result as SEG signals (ORG_SEG1 to ORG_SEG16) of one row (16 printing elements) to a selector 307 of the printhead 31.

In accordance with the sync signal DA_D, the common segment controller 303 generates COM signals (COM1 to COM8) for driving the printhead 31 and a signal (SEG_SELECT) for selecting the SEG signals (SEG1 to SEG16). The common segment controller 303 supplies these signals to the selector 307 of the printhead 31. In accordance with the signal (SEG_SELECT), the selector 307 distributes the SEG signals (ORG_SEG1 to ORG_SEG16) to SEG signals of blocks 1 to 10.

Figure 16:
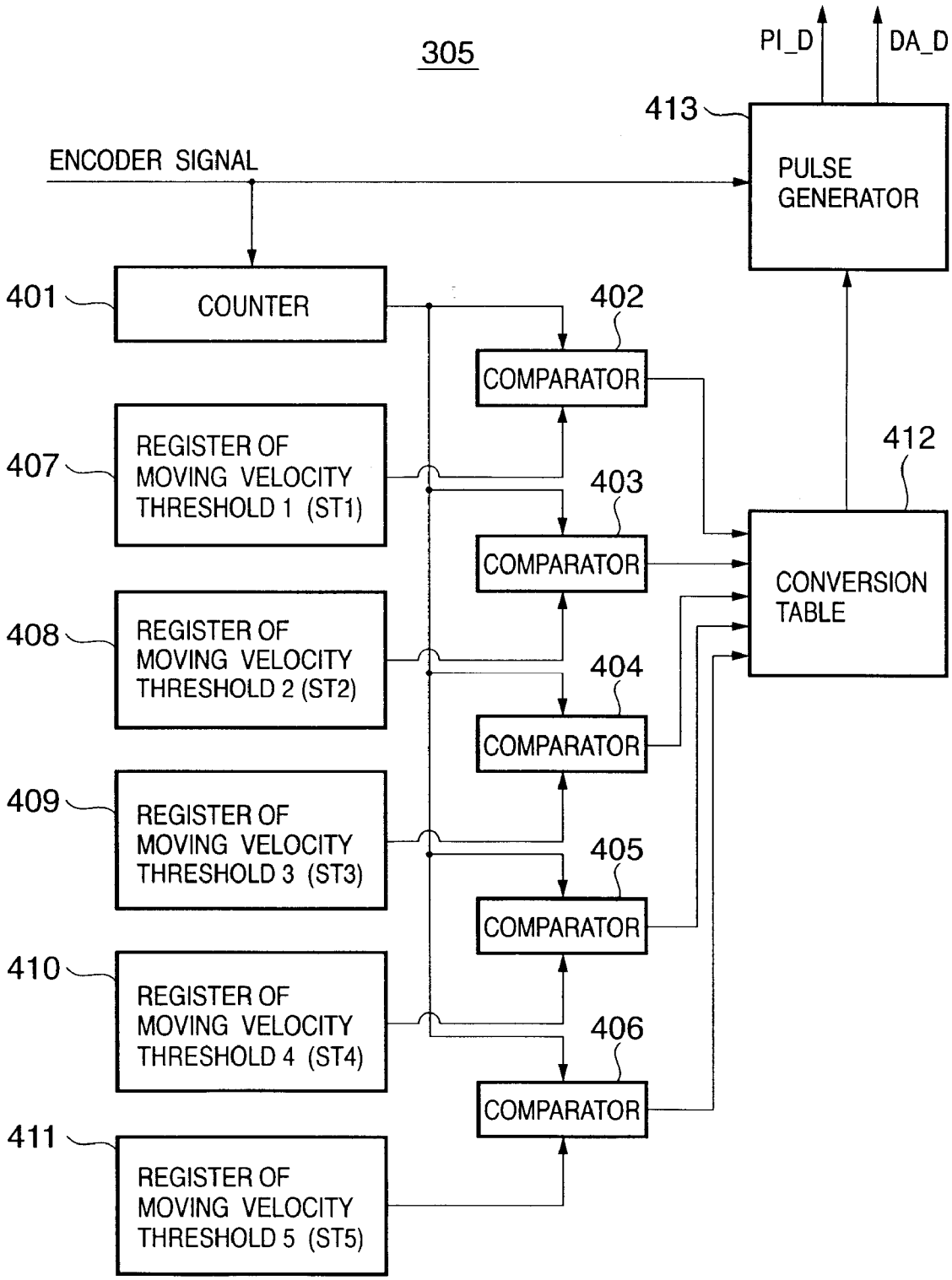
FIG. 16 is a block diagram showing the arrangement of a timing adjusting unit 305.

FIG. 16 is a block diagram showing the configuration of the timing adjusting unit 305.

As shown in FIG. 16, this timing adjusting unit 305 includes a counter 401, comparators 402 to 406, registers 407 to 411, a conversion table 412, and a pulse generator 413.

The counter 401 detects the pulse width of an encoder signal and measures the pulse interval of the encoder signal on the basis of an internal clock. The counter 401 outputs the measurement value to the comparators 402 to 406. The registers 407 to 411 each store a predetermined set value. The comparators 402 to 406 compare these set values with the measurement value and output the comparison results to the conversion table 412. In accordance with the input comparison results from these comparators, the conversion table 412 controls the generation interval of pulses from the pulse generator 413.

The encoder signal is set so that one pulse is generated when the housing 3 of the printing apparatus moves about 0.07 mm. In this embodiment, printing elements in one block can be driven at an interval of a minimum of 10 μsec. Therefore, the printhead can print data at an interval of 10 μsec×8 (the number of time divisions per block)×10=800 μsec or more as a whole. Note that an operating clock of 20 MHz is used in this embodiment.

Counter set values, which are set in the registers 407 to 411 to detect the velocity, are shown in Table 1.

TABLE 1

| | Register set value (hexadecimal representation | Complementary velocity (housing velocity) | Complementary time (μsec) |
|---|---|---|---|
| Moving velocity threshold 1 | 4484h | 80 mm/s | 17,540 |
| Moving velocity threshold 2 | 48F8h | 75 mm/s | 18,680 |
| Moving velocity threshold 3 | 4E20h | 70 mm/s | 20,000 |
| Moving velocity threshold 4 | 5528h | 65 mm/s | 21,800 |
| Moving velocity threshold 5 | 5C30h | 60 mm/s | 23,600 |

Each row interval is ΔD=0.006 mm. The relationship between the conversion table output and the complementary time according to the moving velocity of the housing 3 is set as shown in Table 2.

TABLE 2

| Moving velocity range (ST) | Conversion table output (hexadecimal representation) | Complementary time (μs) |
|---|---|---|
| ST1 ≦ ST | 5DCh | 75 |
| ST1 < ST ≦ ST2 | 640h | 80 |
| ST2 < ST ≦ ST3 | 6A4h | 85 |
| ST3 < ST ≦ ST4 | 730h | 92 |
| ST4 < ST ≦ ST5 | 7D0h | 100 |
| ST < ST5 | 800h | 1,024 |

Figure 17:
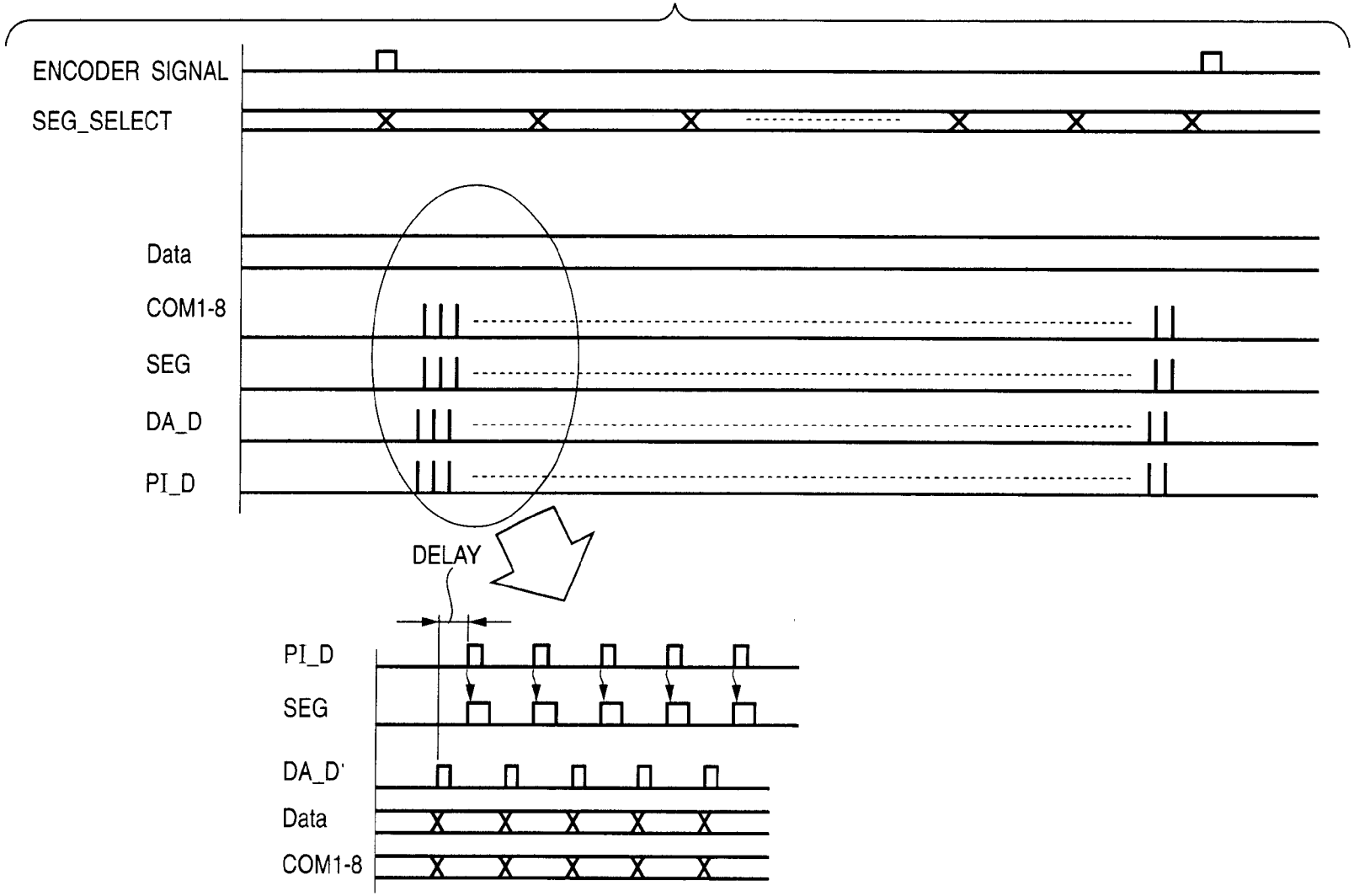
FIG. 17 is a timing chart showing various signal waveforms used in the head I/F 201.

FIG. 17 is a view showing various signal waveforms used in the head I/F 201.

The select signal (SEG_SELECT) counts pulses of the sync signal DA_D and selects one of blocks 1 to 10 whenever counting eight pulses, such that the individual selected blocks are different from one another. The 16-bit printing signal (Data) is sequentially output from the generator 301 in accordance with pulses of the sync signal DA_D. COM1 to COM8 are output in accordance with pulses of the sync signal DA_D so as to repeat signal pulses of COM1 to COM8. As shown in FIG. 17, the sync signal PI_D is output with delay from the sync signal DA_D.

In addition, as shown in FIG. 17, the SEG signal is output in synchronism with the sync signal PI_D pulse. When data of one line of the printhead is completely printed, a series of operations based on the sync signals (PI_D and DA_D) are terminated. When the encoder signal is again input, these operations are repeated. If the pulse width of the encoder signal changes (i.e., if the moving velocity of the housing 3 of the apparatus changes), the set value also changes. As a result, the driving pulse width also changes from the next line in accordance with a new table output.

With this arrangement, the moving velocity of the printing apparatus moved by a user is detected, and the detection result is transmitted to the CPU. In accordance with this detection result, i.e., in accordance with the moving velocity of the printing apparatus, the CPU can control driving of the printhead. In particular, the driving subsystem controller of the printhead calculates an optimum driving pulse width and a delay value between driving pulses in each group, on the basis of the period of an input latch signal and the read values of the temperature sensor and the rank heater arranged in the printhead, thereby suppressing an electric current instantaneously flowing through the lines of the heater driving power supply $V_H$ and the power supply ground HGND. Also, to prevent deterioration of the printing quality during printing by a lowering of the accuracy of printing positions caused by driving pulse timing dispersion, the moving velocity of the printing apparatus is detected, and a signal for performing block selection is generated on the basis of the detection result.

Note that a discharge period (T) according to a detected moving velocity is obtained as follows.

Figure 17A:
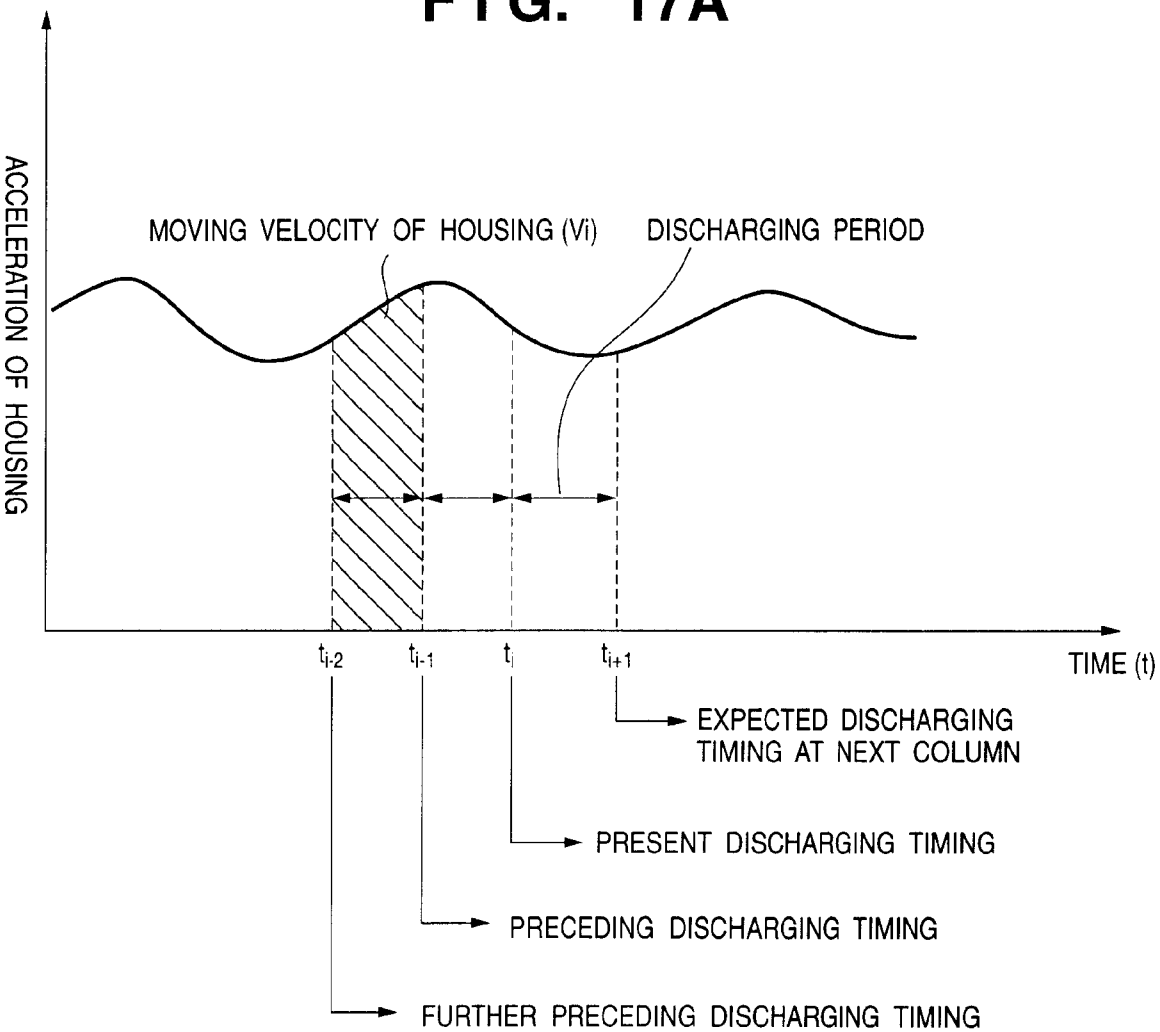
FIG. 17A is a time variation of acceleration of a housing.

As shown in FIG. 17A, an average of moving velocities over a range from the present column, which is the present velocity measurement point, to an i-th preceding columm, $V=(\Sigma Vi)/I$, is obtained. Assuming that a distance (which is dependent on a print resolution) between the present column and the next column is L, an expected time until a discharge in the next column is obtained as $T=L/V$.

In the example shown in FIG. 17A, a variation of acceleration of a housing is detected over a range from a point ($t=t_{i-2}$) where it is located at least two columns before a discharging operation from the printhead to a point ($t_{i-1}$) where it is located one column before the discharging operation. Then, a period of a driving signal to be supplied to the printhead from the present column (at $t=t_i$) to the next column (at $t=t_{i+1}$) is obtained, based on an approximated integral value including the variation of acceleration.

According to FIG. 17A, for example, the integral value is obtained by integrating the acceleration of the housing over time (t) from $t=t_{i-2}$ to $t_{i-1}$. By doing this, a contribution due to the variation of acceleration of the housing is considered. Note that this integration may be numerically approximated by a suitable approximation formula.

Furthermore, the interval between driving pulses to be supplied to the printhead is changed in the printing apparatus in accordance with the moving velocity of the printing apparatus.

According to the embodiment as described above, the driving pulse timings can be dispersed so that an instantaneous current flowing through the printhead does not exceed the standard of the built-in battery power supply. It is also possible to prevent degradation of the printing quality caused by changes in the moving velocity of the printing apparatus.

Other advantages are that fine control operations can be collectively executed by referring to the table, and the printing timings can be controlled by simple calculations.

The arrangement of the timing adjusting unit 301 is not limited to the one shown in FIG. 16. For example, an arrangement as shown in FIG. 18 can also be used.

Figure 18:
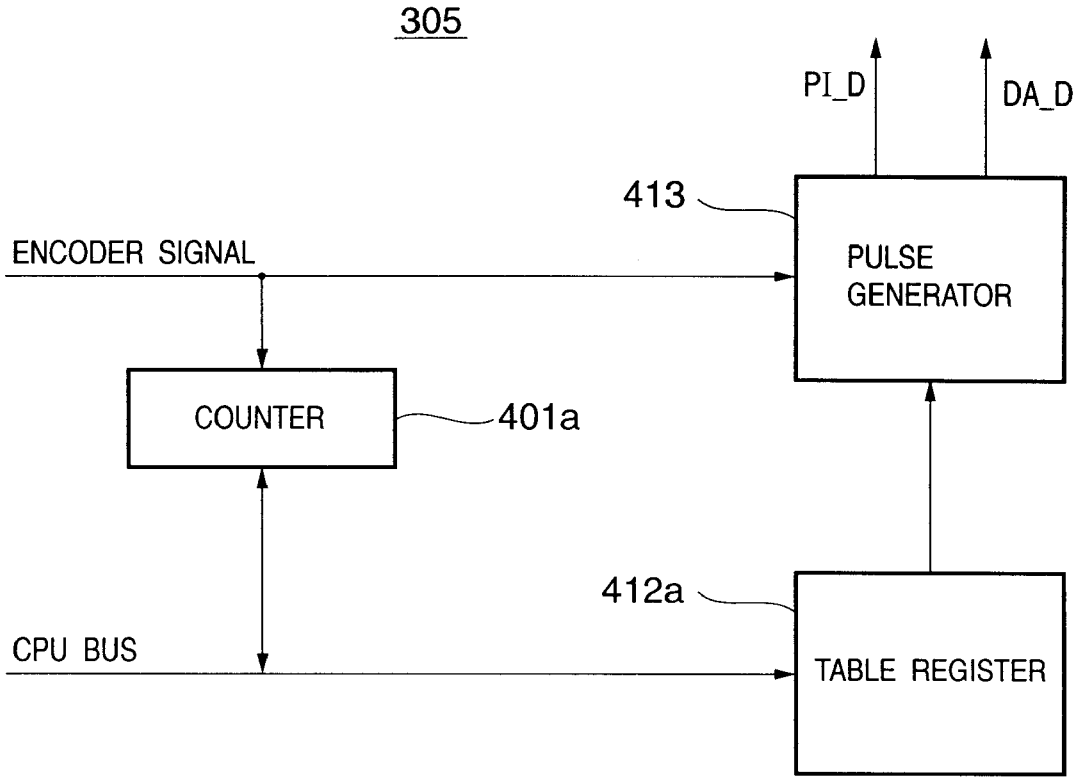
FIG. 18 is a block diagram showing another arrangement of the timing adjusting unit 305.

In this arrangement shown in FIG. 18, the CPU 205 can perform processing instead of the comparators 402 to 406. The CPU 205 reads the value of a counter 401*a* measured when an encoder signal is input, and compares the measurement value with a preset memory value. In accordance with the comparison result, the CPU 205 inputs a value to a table register 412*a* to implement the same operation as in the arrangement shown in FIG. 16.

Figure 19:
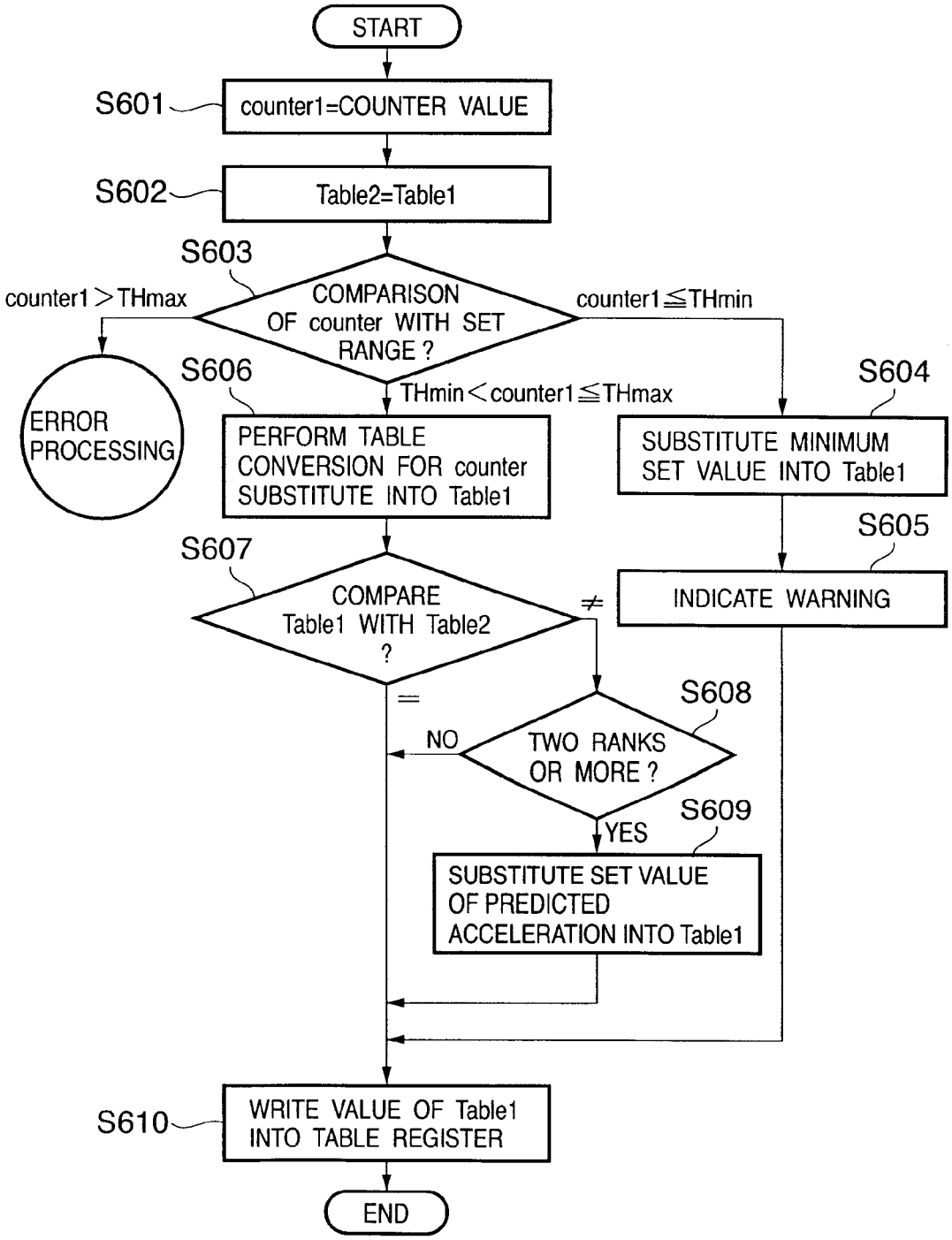
FIG. 19 is a flow chart showing a timing adjusting process.
Figure 20:
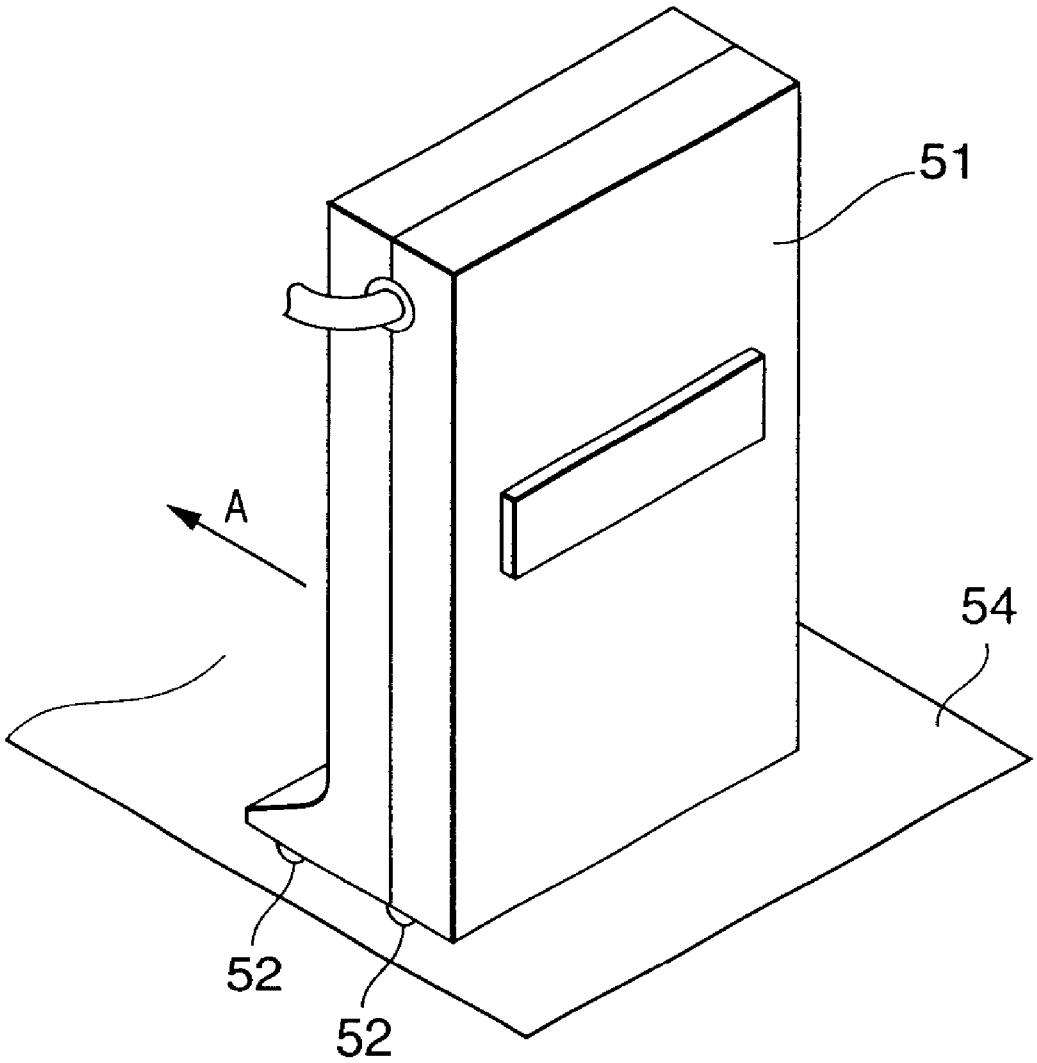
FIG. 20 is a schematic perspective view of a conventional manual printing apparatus.
Figure 21:
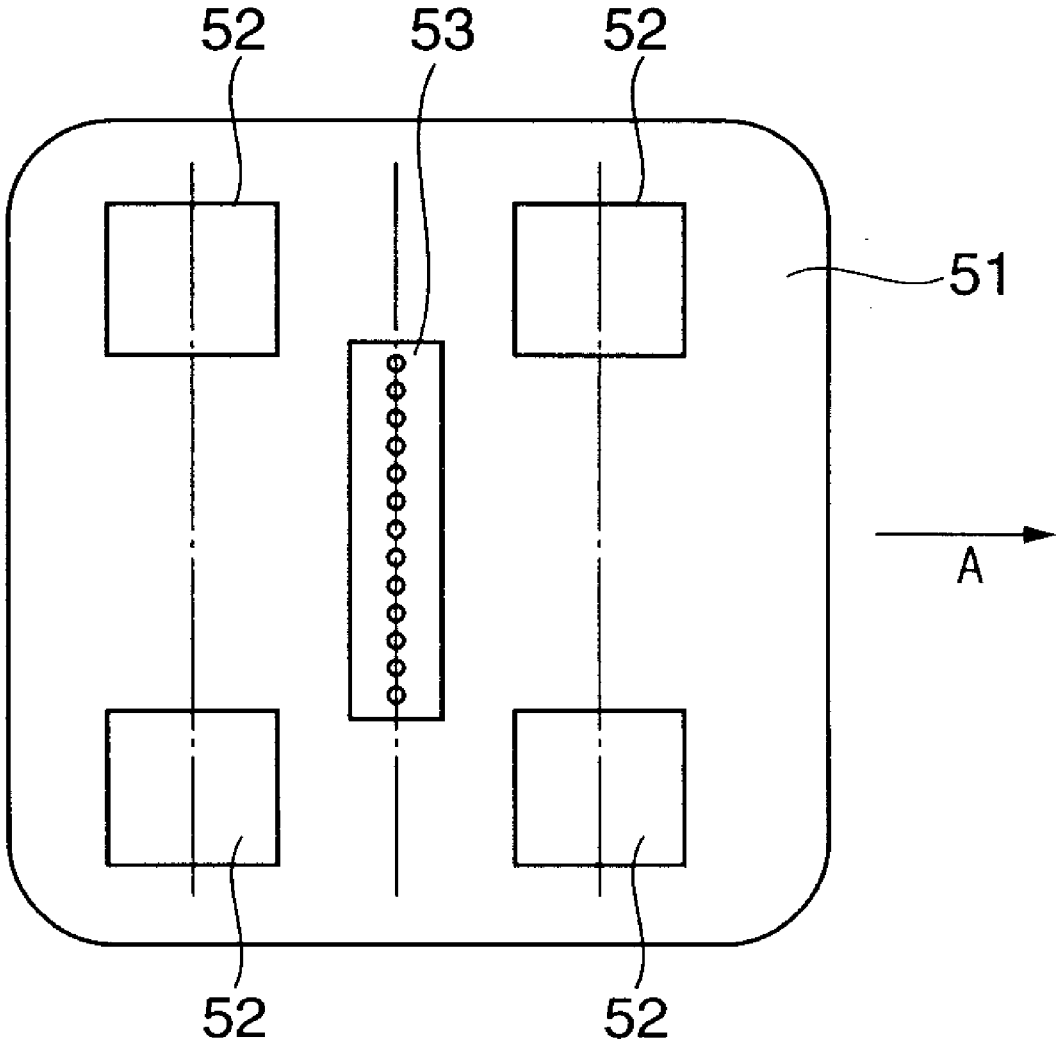
FIG. 21 is a bottom view of the conventional manual printing apparatus.

FIG. 19 is a flow chart showing the timing adjusting process executed by the CPU 205 in connection with the operation shown in FIG. 18.

In step S601, the CPU 205 reads the value of the counter 401*a* being measured when an encoder signal is input, and sets this value as counter1. In step S602, the CPU 205 stores a table value (Table1) set last in the table register 412*a* as Table 2.

In step S603, the CPU 205 compares counter1 with set values (THmax and THmin). If counter1>THmax, no printing operation can be executed because the moving velocity of the housing 3 is too fast, so the CPU 205 determines that this is overspeeding, and the flow advances to predetermined error processing (e.g., turning on of the LED 5). On the other hand, if counter1≦THmin, the flow advances to step S604, and the CPU 205 sets a predetermined value (minimum set value) as the table value (Table 1). In step S605, the CPU 205 turns on the LED 5 as a warning lamp. If THmin<counter1≦THmax, the flow advances to step S606.

In step S606, the value of the counter 401*a* measured in step S601 is subjected to table conversion, and the converted value is set as the table value (Table1).

In step S607, the CPU 205 compares the values of Table 1 and Table 2. If Table 1≠Table 2, the flow advances to step S608, and the CPU 205 further checks whether the set ranges are separated by two ranks or more (this is equivalent to, e.g., a change from ST1<ST≦ST2 to ST3<ST≦ST4 in Table 2). If this change is two ranks or more, the flow advances to step S609, and the CPU 205 substitutes a set value of further one rank or more into Table1 by taking account of a velocity change of housing movement. If the change is one rank or less, the flow advances to step S610.

If Table1=Table2, the flow similarly advances to step S610, and the CPU 205 inputs the value of Table1 to the table register 412*a*.

The above embodiment is explained on the basis of the assumption that the housing basically moves at constant speed. However, accelerated movement can also be processed as indicated in steps S607 to S609 of FIG. 19. Although moving velocities are compared in six stages, the present invention is not limited to this embodiment, so more precise control can of course be performed. It is also naturally possible to perform finer control by increasing the number of table registers.

The above embodiment is explained by taking a printing apparatus which is manually moved along a guide shaft.

However, the present invention is applicable to any printing apparatus whose housing is manually moved, even if the apparatus has no guide shaft.

In the above embodiment, a printer using an inkjet printhead has been explained. However, the present invention is not limited by the type of printhead, as long as a non-impact type printing method which performs time-division control is used.

Furthermore, values set in a conversion table and a register table need not be velocity-converted values. That is, counter values before conversion can also be stored.

Note that, although it is assumed in the above embodiments that a droplet discharged from a printhead is ink and liquid contained in an ink tank is also ink, the present invention is not limited to this. For example, the ink tank might contain processing liquid which is discharged to a printing medium so as to enhance fixing ability and water repellency of a printed image, and the image quality.

However, the embodiments described above have exemplified a printer, which comprises means (e.g., an electrothermal transducer, laser beam generator, and the like) for generating heat energy as energy utilized upon execution of ink discharge, and causes a change in state of an ink by the heat energy, among the ink-jet printers. According to this ink-jet printer and printing method, a high-density, high-precision printing operation can be attained.

As the typical arrangement and principle of the ink-jet printing system, one practiced by use of the basic principle disclosed in, for example, U.S. Pat. Nos. 4,723,129 and 4,740,796 is preferable. The above system is applicable to either one of so-called an on-demand type and a continuous type. Particularly, in the case of the on-demand type, the system is effective because, by applying at least one driving signal, which corresponds to printing information and gives a rapid temperature rise exceeding nucleate boiling, to each of electrothermal transducers arranged in correspondence with a sheet or liquid channels holding a liquid (ink), heat energy is generated by the electrothermal transducer to effect film boiling on the heat acting surface of the printhead, and consequently, a bubble can be formed in the liquid (ink) in one-to-one correspondence with the driving signal. By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with the particularly high response characteristics.

As the pulse driving signal, signals disclosed in U.S. Pat. Nos. 4,463,359 and 4,345,262 are suitable. Note that further excellent printing can be performed by using the conditions described in U.S. Pat. No. 4,313,124 of the invention which relates to the temperature rise rate of the heat acting surface.

As an arrangement of the printhead, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region is also included in the present invention. In addition, the present invention can be effectively applied to an arrangement based on Japanese Patent Laid-Open No. 59-123670 which discloses the arrangement using a slot common to a plurality of electrothermal transducers as a discharge portion of the electrothermal transducers, or Japanese Patent Laid-Open No. 59-138461 which discloses the arrangement having an opening for absorbing a pressure wave of heat energy in correspondence with a discharge portion.

Furthermore, as a full line type printhead having a length corresponding to the width of a maximum printing medium which can be printed by the printer, either the arrangement which satisfies the full-line length by combining a plurality of printheads as disclosed in the above specification or the arrangement as a single printhead obtained by forming printheads integrally can be used.

In addition, not only a cartridge type printhead in which an ink tank is integrally arranged on the printhead itself, as described in the above embodiment, but also an exchangeable chip type printhead which can be electrically connected to the apparatus main unit and can receive an ink from the apparatus main unit upon being mounted on the apparatus main unit can be applicable to the present invention.

It is preferable to add recovery means for the printhead, preliminary auxiliary means, and the like provided as an arrangement of the printer of the present invention since the printing operation can be further stabilized. Examples of such means include, for the printhead, capping means, cleaning means, pressurization or suction means, and preliminary heating means using electrothermal transducers, another heating element, or a combination thereof. It is also effective for stable printing to provide a preliminary discharge mode which performs discharge independently of printing.

Furthermore, as a printing mode of the printer, not only a printing mode using only a primary color such as black or the like, but also at least one of a multi-color mode using a plurality of different colors or a full-color mode achieved by color mixing can be implemented in the printer either by using an integrated printhead or by combining a plurality of printheads.

Moreover, in each of the above-mentioned embodiments of the present invention, it is assumed that the ink is a liquid. Alternatively, the present invention may employ an ink which is solid at room temperature or less and softens or liquefies at room temperature, or an ink which liquefies upon application of a use printing signal, since it is a general practice to perform temperature control of the ink itself within a range from 30° C. to 70° C. in the ink-jet system, so that the ink viscosity can fall within a stable discharge range.

In addition, in order to prevent a temperature rise caused by heat energy by positively utilizing it as energy for causing a change in state of the ink from a solid state to a liquid state, or to prevent evaporation of the ink, an ink which is solid in a non-use state and liquefies upon heating may be used. In any case, an ink which liquefies upon application of heat energy according to a printing signal and is discharged in a liquid state, an ink which begins to solidify when it reaches a printing medium, or the like, is applicable to the present invention. In this case, an ink may be situated opposite electrothermal transducers while being held in a liquid or solid state in recess portions of a porous sheet or through holes, as described in Japanese Patent Laid-Open No. 54-56847 or 60-71260. In the present invention, the above-mentioned film boiling system is most effective for the above-mentioned inks.

In addition, the ink-jet printer of the present invention may be used in the form of a copying machine combined with a reader, and the like, or a facsimile apparatus having a transmission/reception function in addition to an image output terminal of an information processing equipment such as a computer.

The present invention can be applied to a system constituted by a plurality of devices (e.g., host computer, interface, reader, printer) or to an apparatus comprising a single device (e.g., copy machine, facsimile).

Further, the object of the present invention can also be achieved by providing a storage medium storing program codes for performing the aforesaid processes to a system or an apparatus, reading the program codes with a computer (e.g., CPU, MPU) of the system or apparatus from the storage medium, then executing the program.

In this case, the program codes read from the storage medium realize the functions according to the embodiments, and the storage medium storing the program codes constitutes the invention.

Further, the storage medium, such as a floppy disk, a hard disk, an optical disk, a magneto-optical disk, CD-ROM, CD-R, a magnetic tape, a non-volatile type memory card, and ROM can be used for providing the program codes.

Furthermore, besides aforesaid functions according to the above embodiments are realized by executing the program codes which are read by a computer, the present invention includes a case where an OS (operating system) or the like working on the computer performs a part or entire processes in accordance with designations of the program codes and realizes functions according to the above embodiments.

Furthermore, the present invention also includes a case where, after the program codes read from the storage medium are written in a function expansion card which is inserted into the computer or in a memory provided in a function expansion unit which is connected to the computer, CPU or the like contained in the function expansion card or unit performs a part or entire process in accordance with designations of the program codes and realizes functions of the above embodiments.

As many apparently widely different embodiments of the present invention can be made without departing from the spirit and scope thereof, it is to be understood that the invention is not limited to the specific embodiments thereof except as defined in the appended claims.

What is claimed is:

1. A printing apparatus for printing on a printing medium with a printhead while a user moves a housing on the printing medium, comprising:

detecting means for detecting the moving velocity of said housing;

supply means for supplying a driving signal for driving said printhead;

storing means for storing a plurality of velocity thresholds; and adjusting means for comparing a detection result from said detecting means with the plurality of velocity thresholds, and adjusting the supply timing of the driving signal on the basis of the comparing result so as to adjust a printing position, wherein said detecting means detects a variation of acceleration of said housing from a point where said housing is located at least two columns before a discharging operation is to be effected by said printhead to a point where said housing is located one column before the discharging operation is to be effected, and determines a period of the driving signal to be supplied to said printhead, based on an approximated integral value including the variation of acceleration between precedent columns.

2. The apparatus according to claim 1, further comprising input means for inputting printing data from an external apparatus.

3. The apparatus according to claim 2, wherein said input means comprises infrared communicating means for communicating with said external apparatus so as to input the printing data.

4. The apparatus according to claim 1, further comprising a roller for facilitating movement of said housing.

5. The apparatus according to claim 1, wherein said printhead is an inkjet printhead which prints by discharging ink.

6. The apparatus according to claim 5, wherein said inkjet printhead comprises an electrothermal transducer for generating thermal energy to be applied to the ink, in order to discharge the ink by using the thermal energy.

* * * * *